US009061433B2

(12) United States Patent
Nakamura

(10) Patent No.: US 9,061,433 B2
(45) Date of Patent: Jun. 23, 2015

(54) PUNCHING APPARATUS, POST-PROCESSING APPARATUS, AND IMAGE FORMING APPARATUS

(71) Applicant: KYOCERA Document Solutions Inc., Osaka-shi, Osaka (JP)

(72) Inventor: Shigeaki Nakamura, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/043,728

(22) Filed: Oct. 1, 2013

(65) Prior Publication Data

US 2014/0093298 A1 Apr. 3, 2014

(30) Foreign Application Priority Data

Oct. 2, 2012 (JP) ..... 2012-220396

(51) Int. Cl.

| | |
|---|---|
| ***G03G 15/00*** | (2006.01) |
| ***B26D 5/02*** | (2006.01) |
| ***B26D 5/06*** | (2006.01) |
| ***B26D 5/16*** | (2006.01) |
| ***B26F 1/02*** | (2006.01) |

(52) U.S. Cl.

CPC .. *B26D 5/02* (2013.01); *B26D 5/06* (2013.01); *G03G 2215/00818* (2013.01); *G03G 15/6582* (2013.01); *B26D 5/16* (2013.01); *B26F 1/02* (2013.01)

(58) Field of Classification Search

CPC ..... B26D 5/02; B26D 5/06; B26D 5/16; G03G 15/6582; G03G 2215/00818; B26F 1/02; B26F 1/04

USPC ..... 399/407; 83/74, 522.15; 270/58.07

See application file for complete search history.

(56) References Cited

U.S. PATENT DOCUMENTS

| | | | |
|---|---|---|---|
| 6,386,080 | B1 | 5/2002 | Okamoto et al. |
| 2005/0000336 | A1 * | 1/2005 | Hattori et al. |
| 2007/0056423 | A1 | 3/2007 | Yamada et al. |
| 2007/0107577 | A1 | 5/2007 | Hattori et al. |
| 2008/0236351 | A1 * | 10/2008 | Hidaka et al. |
| 2011/0081185 | A1 * | 4/2011 | Motoi et al. |

FOREIGN PATENT DOCUMENTS

| | | |
|---|---|---|
| JP | 2000-153953 | 6/2000 |
| JP | 2005075550 A | 3/2005 |
| JP | 2007099511 A | 4/2007 |

* cited by examiner

*Primary Examiner* — Blake A Tankersley

(74) *Attorney, Agent, or Firm* — Alleman Hall McCoy Russell & Tuttle LLP

(57) ABSTRACT

A post-processing apparatus according to one aspect of the present disclosure includes a punching apparatus that has: a punching blade; an orthogonal direction movement portion that moves the punching blade in an orthogonal direction; a converting mechanism that converts rotational movement of a rotation member in a first rotation direction to reciprocating movement; a rotation driving portion that drives rotation of the rotation member; a rotation driving control portion; and an orthogonal direction movement control portion. The rotation driving control portion controls the rotation driving portion so as to move the punching blade toward a punching reference position when a reference position detection portion determines that the punching blade has moved beyond the punching reference position toward a through hole punching position, in a case where the punching blade is controlled so as to stop at the punching reference position.

6 Claims, 12 Drawing Sheets

PUNCHING APPARATUS, POST-PROCESSING APPARATUS, AND IMAGE FORMING APPARATUS

INCORPORATION BY REFERENCE

This application is based upon and claims the benefit of priority from the corresponding Japanese Patent Application No. 2012-220396 filed on Oct. 2, 2012, the entire contents of which are incorporated herein by reference.

BACKGROUND

The present disclosure relates to punching apparatuses, post-processing apparatuses, and image forming apparatuses.

To date, punching apparatuses, for post-processing apparatuses, which perform punching process at predetermined positions in paper sheets (mediums on which image formation is performed) discharged from image forming apparatus bodies, have been known. The punching apparatus includes a punching blade (hole-punching blade), a paper sheet width direction movement portion (orthogonal direction movement portion), a cylindrical member (rotation member), and punching-completion detection means. The paper sheet width direction movement portion moves the punching blade in a paper sheet width direction orthogonal to a paper sheet conveying direction. In the cylindrical member, the punching blade is disposed so as to project from the circumferential surface, and the cylindrical member rotates. The punching-completion detection means detects for completion of the punching process by the punching blade.

In the conventional punching apparatus, in a case where the punching-completion detection means detects completion of the punching process, the paper sheet width direction movement portion moves the punching blade in the paper sheet width direction. Thus, the conventional punching apparatus enables efficient execution of the punching process, and reduction of time for the punching process.

In the conventional punching apparatus, even when rotation of the cylindrical member is to be stopped so as to stop the punching blade at a punching reference position after the completion of the punching process, the cylindrical member may rotate due to inertia. Thus, the punching blade may move beyond the punching reference position toward a through hole punching position. When the punching blade moves beyond the punching reference position toward the through hole punching position, the punching blade may stop with the punching blade penetrating the paper sheet. If the punching blade is moved in the paper sheet width direction with the punching blade penetrating the paper sheet, the paper sheet may be damaged by the punching blade.

SUMMARY

A post-processing apparatus according to one aspect of the present disclosure is directed to a post-processing apparatus connectable to an image forming apparatus body that forms an image on a medium on which image formation is performed. The post-processing apparatus includes: a conveying portion that conveys a medium on which image formation is performed; and a punching apparatus. The punching apparatus includes a punching blade, an orthogonal direction movement portion, a converting mechanism, a rotation driving portion, a reference position detection portion, an orthogonal direction movement control portion, and a rotation driving control portion. The punching blade is movable between a punching reference position and an orthogonal direction waiting position, and is movable between the punching reference position and a through hole punching position at which the medium on which image formation is performed is penetrated, and the punching reference position is a position which is distant from the medium on which image formation is performed, is in an orthogonal direction orthogonal to a direction in which the medium on which image formation is performed is conveyed, and at which the punching process is performed for the medium on which image formation is performed, and the orthogonal direction waiting position is a position that is distant, by a predetermined distance, from the punching reference position in the orthogonal direction. The orthogonal direction movement portion moves the punching blade in the orthogonal direction. The converting mechanism has a rotation member that can rotate in a first rotation direction, and converts rotational movement of the rotation member in the first rotation direction to reciprocating movement of the punching blade between the punching reference position and the through hole punching position. The rotation driving portion drives rotation of the rotation member. The reference position detection portion can determine that the punching blade is positioned at the punching reference position or that the punching blade is not positioned at the punching reference position. The orthogonal direction movement control portion controls the orthogonal direction movement portion so as to move the punching blade in the orthogonal direction. The rotation driving control portion controls the rotation driving portion so as to stop rotating the rotation member such that the punching blade is moved from the through hole punching position to the punching reference position and is stopped at the punching reference position. The rotation driving control portion controls the rotation driving portion so as to rotate the rotation member in a second rotation direction opposite to the first rotation direction such that the punching blade is moved toward the punching reference position, when the reference position detection portion determines that the punching blade has moved beyond the punching reference position toward the through hole punching position, in a case where the rotation driving portion is controlled so as to stop rotating the rotation member such that the punching blade is stopped at the punching reference position. The orthogonal direction movement control portion controls the orthogonal direction movement portion so as to move the punching blade to the orthogonal direction waiting position, in a case where the rotation driving control portion controls the rotation driving portion so as to rotate the rotation member in the second rotation direction such that the punching blade is moved toward the punching reference position.

An image forming apparatus according to another aspect of the present disclosure includes an image forming apparatus body that forms an image on a medium on which image formation is performed, and the post-processing apparatus described above.

A punching apparatus according to still another aspect of the present disclosure is directed to a punching apparatus that performs a punching process on a sheet conveyed by a conveying portion which conveys sheets. The punching apparatus includes a punching blade, an orthogonal direction movement portion, a converting mechanism, a rotation driving portion, a reference position detection portion, an orthogonal direction movement control portion, and a rotation driving control portion. The punching blade is movable between a punching reference position and an orthogonal direction waiting position, and is movable between the punching reference position and a through hole punching position at which the sheet is penetrated, and the punching reference position is a position which is distant from the sheet, is in an orthogonal direction orthogonal to a direction in which the sheet is conveyed, and at which the punching process is performed for the sheet, and the orthogonal direction waiting position is a position that is distant, by a predetermined distance, from the punching reference position in the orthogonal direction. The orthogonal direction movement portion moves the punching blade in the orthogonal direction. The converting mechanism has a rotation member that can rotate in a first rotation direction, and converts rotational movement of the rotation member in the first rotation direction to reciprocating movement of the punching blade between the punching reference position and the through hole punching position. The rotation driving portion drives rotation of the rotation member. The reference position detection portion can determine that the punching blade is positioned at the punching reference position or that the punching blade is not positioned at the punching reference position. The orthogonal direction movement control portion controls the orthogonal direction movement portion so as to move the punching blade in the orthogonal direction. The rotation driving control portion controls the rotation driving portion so as to stop rotating the rotation member such that the punching blade is moved from the through hole punching position to the punching reference position and is stopped at the punching reference position. The rotation driving control portion controls the rotation driving portion so as to rotate the rotation member in a second rotation direction opposite to the first rotation direction such that the punching blade is moved toward the punching reference position, when the reference position detection portion determines that the punching blade has moved beyond the punching reference position toward the through hole punching position, in a case where the rotation driving portion is controlled so as to stop rotating the rotation member such that the punching blade is stopped at the punching reference position. The orthogonal direction movement control portion controls the orthogonal direction movement portion so as to move the punching blade to the orthogonal direction waiting position, in a case where the rotation driving control portion controls the rotation driving portion so as to rotate the rotation member in the second rotation direction such that the punching blade is moved toward the punching reference position.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
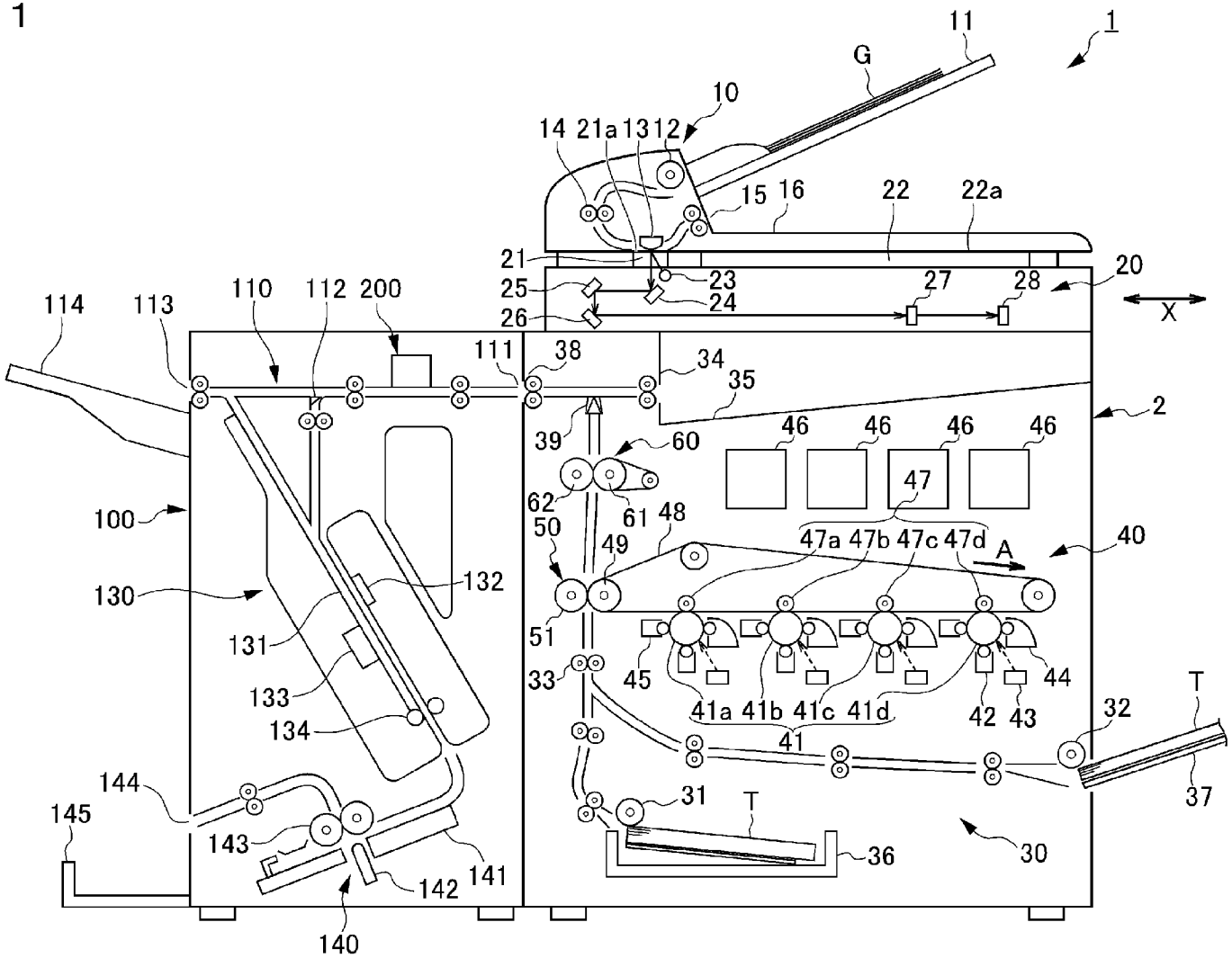
FIG. 1 illustrates the entire structure of a copy machine, according to one embodiment of the present disclosure, which is an example of an image forming apparatus.

Hereinafter, a copy machine 1, according to one embodiment of the present disclosure, which is an example of an image forming apparatus will be described with reference to the drawings. Firstly, the entire structure of the copy machine 1 will be described. FIG. 1 illustrates the entire structure of the copy machine 1, according to one embodiment, which is an example of the image forming apparatus.

The copy machine 1 includes: a copy machine body (image forming apparatus body) 2 which forms a toner image on a paper sheet T; and a post-processing apparatus 100, disposed closer to a paper sheet discharge side of the copy machine body 2, which performs a punching process, a stapling process, and a folding process on the paper sheet (medium on which image formation is performed, sheet) T having the toner image formed thereon. The post-processing apparatus 100 is coupled to the copy machine body 2. The copy machine body 2 includes a document sheet conveying portion 10, a document sheet reading portion 20, a first paper sheet conveying portion 30, an image forming portion 40, a transfer portion 50, and a fixing portion 60.

The document sheet conveying portion 10 is an ADF (Auto Document Feeder), and includes a document sheet placing portion 11, a first feed roller 12, a guide 13, a pair of timing rollers 14, and a document sheet discharge portion 15. The first feed roller 12 is used to sequentially feed, one by one, document sheets G placed on the document sheet placing portion 11 to the pair of timing rollers 14. The pair of timing rollers 14 is used to convey the document sheet G or stop conveying the document sheet G such that a time when the document sheet reading portion 20 reads the document sheet G matches a time when the document sheet G is fed to a position (a position at which the guide 13 is positioned) where the document sheet G is read by the document sheet reading portion 20. The guide 13 is used to guide the conveyed document sheet G to a first reading surface 21*a* described below. The document sheet discharge portion 15 discharges the document sheet G having been read by the document sheet reading portion 20 (having passed through the guide 13) externally from the copy machine body 2. Outside the document sheet discharge portion 15 in the copy machine body 2, a document sheet stacking portion 16 is formed. In the document sheet stacking portion 16, the document sheets G discharged from the document sheet discharge portion 15 are layered and stacked.

The document sheet reading portion 20 includes the first reading surface 21*a* and a second reading surface 22*a*. The first reading surface 21*a* is formed along a top surface of a first contact glass 21 opposing the guide 13, and is a surface on which the document sheet G is read. The second reading surface 22*a* is disposed adjacent to the first reading surface 21*a* (in FIG. 1, disposed over most of a portion to the right of the first reading surface 21*a*). The second reading surface 22*a* is used to read the document sheet G without using the document sheet conveying portion 10. The second reading surface 22*a* is formed along a top surface of a second contact glass 22 on which the document sheet G is placed, and is a surface on which the document sheet G is read.

Further, the document sheet reading portion 20 includes, in the copy machine body 2, a lighting portion 23, a first mirror 24, a second mirror 25, a third mirror 26, an imaging lens 27, and an imaging portion 28. The lighting portion 23 and the first mirror 24 are moved in a secondary scanning direction X. The second mirror 25 and the third mirror 26 are positioned to the left of the lighting portion 23 and the first mirror 24 in FIG. 1. Further, the second mirror 25 and the third mirror 26 are moved in the secondary scanning direction X such that a distance (light path length) from the first reading surface 21*a* or the second reading surface 22*a* to the imaging portion 28 through the first mirror 24, the second mirror 25, the third mirror 26, and the imaging lens 27 is maintained constant.

The lighting portion 23 is a light source that applies light to the document sheet G. The first mirror 24, the second mirror 25, and the third mirror 26 are mirrors that guide light reflected by the document sheet G to the imaging lens 27 so as to maintain the light path length constant. The imaging lens 27 focuses light incident from the third mirror 26 on the imaging portion 28 to form an image. The imaging portion 28 includes a plurality of imaging elements that are aligned along a primary scanning direction Y (a direction orthogonal to the secondary scanning direction X). Each imaging element converts the incident light to an electrical signal to obtain image data based on a formed light image, and is implemented as, for example, a charge coupled device (CCD).

The first paper sheet conveying portion 30 includes a second feed roller 31, a third feed roller 32, a pair of registration rollers 33, a switching portion 39, a first paper sheet discharge portion 34, and a second paper sheet discharge portion 38. The second feed roller 31 is used to feed the paper sheet T stored in a sheet feed cassette 36, to the transfer portion 50. The third feed roller 32 is used to feed the paper sheet T placed on a manual feed tray 37, to the transfer portion 50. The pair of registration rollers 33 is used to convey the paper sheet T or stop conveying the paper sheet T such that a time when a toner image is formed on the transfer portion 50 matches a time when the paper sheet T is fed to the transfer portion 50. Further, the pair of registration rollers 33 is used to correct a skew (diagonally feeding of a sheet) of the paper sheet T. The switching portion 39 switches a direction in which the paper sheet T is conveyed so as to convey the paper sheet T conveyed from the fixing portion 60 to one of the first paper sheet discharge portion 34 or the second paper sheet discharge portion 38. The first paper sheet discharge portion 34 and the second paper sheet discharge portion 38 discharge the paper sheet T having a toner image fixed thereon, externally from the copy machine body 2. Outside the first paper sheet discharge portion 34 in the copy machine body 2, a discharged sheet stacking portion 35 is formed. In the discharged sheet stacking portion 35, the paper sheets T discharged from the first paper sheet discharge portion 34 are layered and stacked.

The image forming portion 40 includes a photosensitive drum 41, a charging portion 42, a laser scanner unit 43, a development unit 44, a cleaning portion 45, a toner cartridge 46, a primary transfer roller 47, an intermediate transfer belt 48, and an opposing roller 49. The photosensitive drum 41 (41*a*, 41*b*, 41*c*, 41*d*) acts as a photosensitive member or an image carrier in order to form black, cyan, magenta, and yellow toner images. Around each of the photosensitive drums 41*a*, 41*b*, 41*c*, and 41*d*, the charging portion 42, the laser scanner unit 43, the development unit 44, and the cleaning portion 45 are disposed in order, respectively, from the upstream side toward the downstream side along a direction in which the photosensitive drum 41 rotates. A surface of the photosensitive drum 41 is charged by the charging portion 42. The laser scanner unit 43 is spaced from the surface of the photosensitive drum 41, and scans and exposes the surface of the photosensitive drum 41 to light based on image data associated with the document sheet G read by the document sheet reading portion 20. Thus, charge on a portion of the surface, of the photosensitive drum 41, which has been exposed to light, is eliminated to form an electrostatic latent image. The development unit 44 is used to apply toner to the electrostatic latent image formed on the surface of the photosensitive drum 41, to from a toner image. The cleaning portion 45 is used to eliminate, by means of a charge eliminator (not shown), the toner or the like left on the surface of the photosensitive drum 41 after charge on the surface of the photosensitive drum 41 is eliminated. The toner cartridge 46 stores toner, of each color, to be supplied to the development unit 44. The toner cartridge 46 and the development unit 44 are connected to each other through a toner supply path (not shown).

The primary transfer roller 47 (47*a*, 47*b*, 47*c*, and 47*d*) is disposed on the side, of the intermediate transfer belt 48, opposite to the photosensitive drum 41*a*, 41*b*, 41*c*, and 41*d* sides, respectively. The intermediate transfer belt 48 passes through the image forming portion 40 and the transfer portion 50. A portion of the intermediate transfer belt 48 is sandwiched between the photosensitive drums 41*a*, 41*b*, 41*c*, and 41*d* and the primary transfer rollers 47*a*, 47*b*, 47*c*, and 47*d*, respectively, and the toner image formed on the surface of each of the photosensitive drums 41*a*, 41*b*, 41*c*, and 41*d* is primarily transferred to the intermediate transfer belt 48. The opposing roller 49 is a driving roller which is disposed inward of the intermediate transfer belt 48 having an annular shape, and which moves the intermediate transfer belt 48 in the direction indicated by an arrow A in FIG. 1.

The transfer portion 50 includes a secondary transfer roller 51. The secondary transfer roller 51 is disposed on the side, of the intermediate transfer belt 48, opposite to the opposing roller 49 side, and a portion of the intermediate transfer belt 48 is sandwiched between the secondary transfer roller 51 and the opposing roller 49. Further, the secondary transfer roller 51 is used to secondarily transfer, to the paper sheet T, the toner image which has been primarily transferred to the intermediate transfer belt 48.

The fixing portion 60 includes a heating rotating member 61 and a pressurizing rotating member 62. The heating rotating member 61 and the pressurizing rotating member 62 sandwich the paper sheet T to which the toner image has been secondarily transferred therebetween, and the toner is fused and pressurized to fix the toner onto the paper sheet T.

The post-processing apparatus 100 includes a second paper sheet conveying portion 110 as a conveying portion, a punching apparatus 200, a stapling portion 130, and a folding portion 140. The second paper sheet conveying portion 110 includes an entrance portion 111, a diverter guide 112, and a first discharge portion 113. Through the entrance portion 111, the paper sheet T discharged from the second paper sheet discharge portion 38 of the copy machine body 2 is conveyed into the post-processing apparatus 100, to convey the paper sheet T to the punching apparatus 200. The diverter guide 112 switches a direction in which the paper sheet T discharged from the punching apparatus 200 is conveyed, to one of a direction toward the first discharge portion 113 or a direction toward the stapling portion 130. The first discharge portion 113 is used to discharge, from the post-processing apparatus 100, the paper sheet T discharged from the punching apparatus 200 and the paper sheet T discharged from the stapling portion 130. A main tray 114 is disposed outside the first discharge portion 113 of the post-processing apparatus 100. On the main tray 114, the paper sheets T discharged from the first discharge portion 113 are layered and stacked. The punching apparatus 200 performs a series of processes for punching process in which holes used for binding the paper sheets T are formed at predetermined positions in the paper sheet T. The punching apparatus 200 will be described below in detail.

The stapling portion 130 is used to bind (perform stapling process) the paper sheets T by using staples (binders), and includes a paper sheet receiving table 131, a receiving stopper 132, a stapling process portion 133, and a conveyor roller 134. On the paper sheet receiving table 131, a plurality of the paper sheets T conveyed from the punching apparatus 200 by switching in the diverter guide 112 are temporality stored. The receiving stopper 132 receives the lower end portions of the paper sheets T conveyed onto the paper sheet receiving table 131, and holds the paper sheets T. The stapling process portion 133 moves to the vicinity of the ends or the vicinity of the center of the paper sheets T which are temporarily stored on the paper sheet receiving table 131, and performs the stapling process for the paper sheets T in the vicinity of the ends or the vicinity of the center thereof. The conveyor roller 134 is used to convey a bundle of (bound) paper sheets obtained by performing the stapling process for the paper sheets T in the vicinity of the center thereof, from the paper sheet receiving table 131 toward the folding portion 140.

The folding portion 140 half-folds (performs booklet folding process) the bundle of paper sheets having been bound, in the vicinity of the center of the bundle. The folding portion 140 includes a folding reception table 141, a pushing portion 142, a pair of folding rollers 143, and a second discharge portion 144. On the folding reception table 141, a bundle of paper sheets having been bound by the stapling portion 130 is placed. The pushing portion 142 is provided so as to be movable in a direction orthogonal to the bundle of paper sheets placed on the folding reception table 141, and moves toward the bundle of paper sheets, so that a portion (a portion on which the stapling process has been performed) in the vicinity of the center of the bundle of paper sheets is pushed in between the pair of folding rollers 143 disposed on a side, of the bundle of paper sheets, opposite to the pushing portion 142 side. The pair of folding rollers 143 is used to fold the bundle of paper sheets pushed by the pushing portion 142 into a booklet, and convey the bundle of paper sheets having been folded toward the second discharge portion 144. Through the second discharge portion 144, the paper sheets T having been folded are discharged from the post-processing apparatus 100. A discharge tray 145 is disposed outside the second discharge portion 144 of the post-processing apparatus 100. On the discharge tray 145, the bundle of paper sheets discharged from the second discharge portion 144 are stacked.

Next, a structure of the punching apparatus 200 that is the feature of the copy machine 1 according to one embodiment will be described with reference to the drawings.

Figure 2:
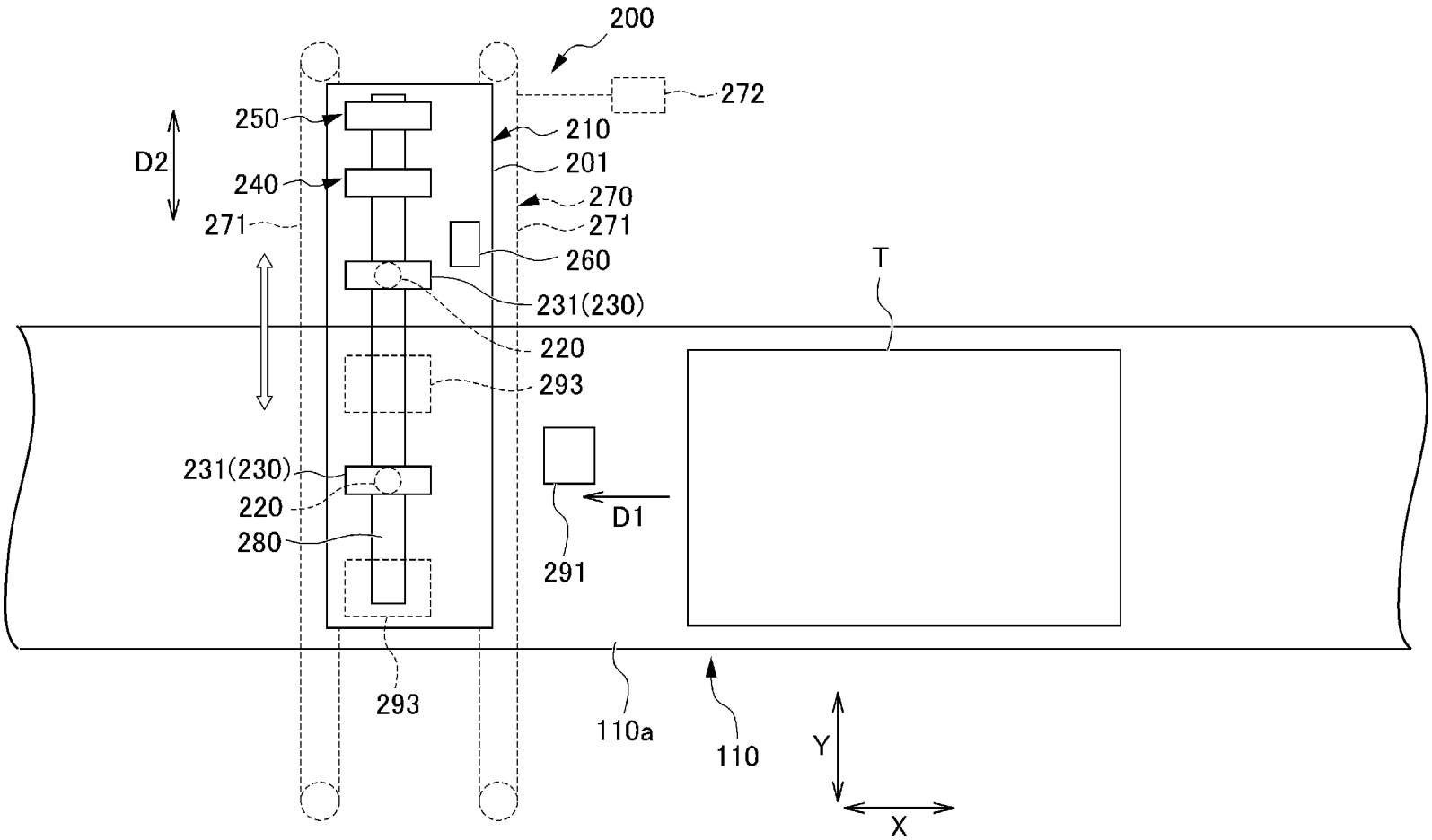
FIG. 2 is a plan view of a portion around a punching apparatus of a post-processing apparatus in the copy machine according to the embodiment.
Figure 3:
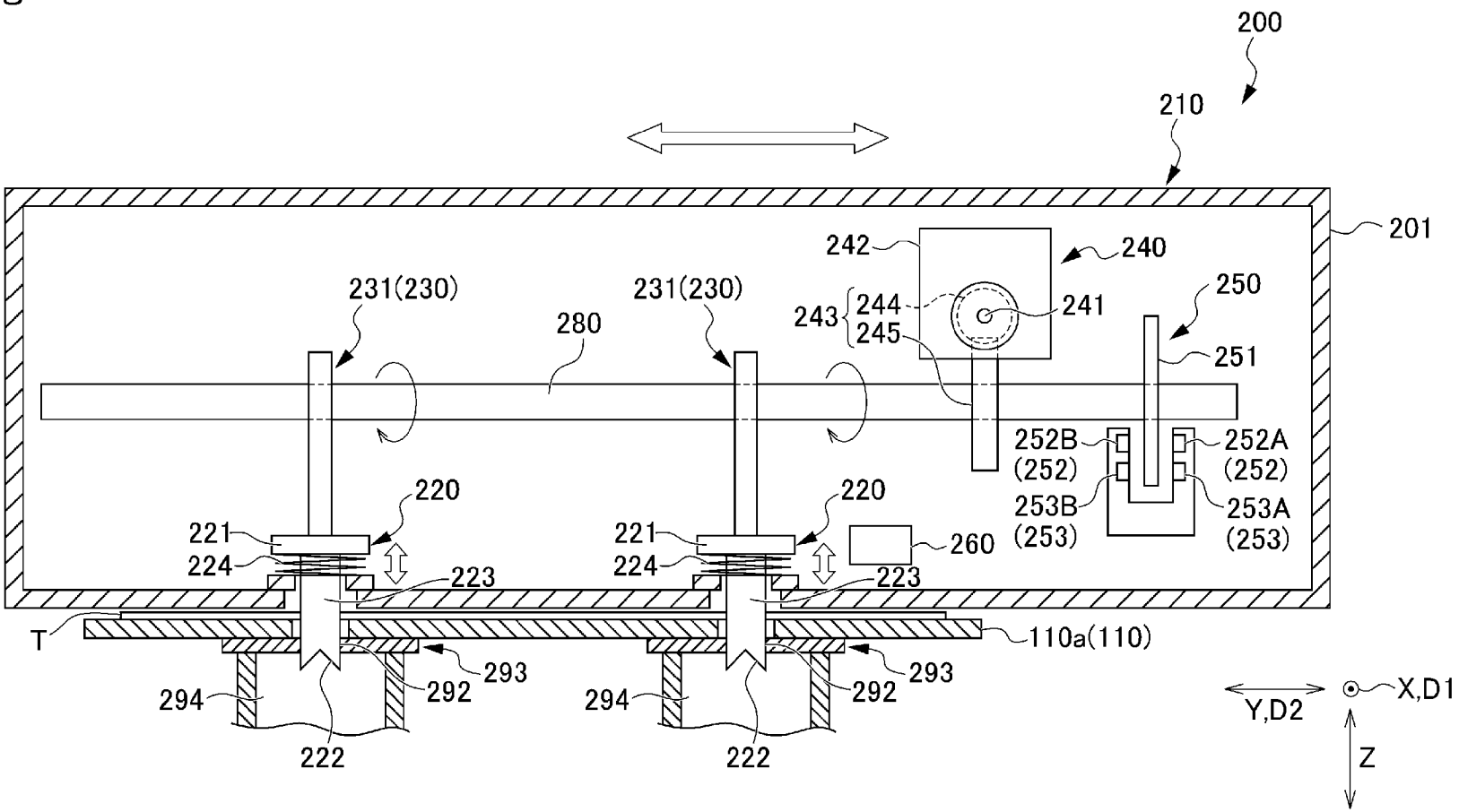
FIG. 3 illustrates the punching apparatus of the post-processing apparatus in the copy machine according to the embodiment, as viewed in the secondary scanning direction.

The punching apparatus 200 performs punching process for the paper sheets T conveyed from the second paper sheet discharge portion 38 in a conveying direction D 1. As shown in FIG. 2 and FIG. 3, the punching apparatus 200 includes a pair of punching portions 220, 220, a pair of blade receivers 293, a converting mechanism 230, a cam rotation portion 240, a rotational position detection portion 250, a paper sheet width direction end detection portion 260 as an orthogonal direction end position detection portion, a paper sheet width direction movement portion 270 as an orthogonal direction movement portion, a paper sheet conveying direction head detection portion 291, a punching scrap storage portion 294, and a punching housing 201.

In the punching housing 201, the pair of punching portions 220, 220, the converting mechanism 230, the cam rotation portion 240, the rotational position detection portion 250, and the paper sheet width direction end detection portion 260 are assembled into one unit and mounted to the punching housing 201 to form a punching unit 210. The punching unit 210 is structured so as to be movable above the second paper sheet conveying portion 110 horizontally in the paper sheet width direction D2 by means of the paper sheet width direction movement portion 270. In FIG. 3, the paper sheet width direction movement portion 270 of the punching unit 210 is not shown. In the present embodiment, the paper sheet width direction D2 is a direction orthogonal to the conveying direction D1 in which the paper sheet T is conveyed by the second paper sheet conveying portion 110. The paper sheet width direction D2 corresponds to the primary scanning direction Y. Further, a direction orthogonal to the conveying direction D1 and the paper sheet width direction D2 is referred to as an up-down direction Z.

As shown in FIG. 2, the paper sheet width direction movement portion 270 extends, in the paper sheet width direction D2, over a paper sheet conveying path plate 110*a* of the second paper sheet conveying portion 110, above the paper sheet conveying path plate 110*a* of the second paper sheet conveying portion 110. The paper sheet width direction movement portion 270 includes two endless transfer belts 271 spaced from each other in the conveying direction D1, and a slide motor 272 that drives the transfer belts 271.

The two transfer belts 271 support the punching housing 201 on the lower side of the punching housing 201. Thus, the paper sheet width direction movement portion 270 can slide the punching unit 210 between a punching reference position that is a position, in the paper sheet width direction D2 (the orthogonal direction), at which punching blades 222 (described below) perform the punching process for the paper sheet T and a paper sheet width direction waiting position (orthogonal direction waiting position) at which the punching blades 222 (described below) are distant from the punching reference position by a predetermined distance in the paper sheet width direction D2.

Each punching portion 220 is disposed on the lower side of the punching unit 210. Each punching portion 220 includes: a top surface plate 221 that abuts an eccentric cam member 231; a cylindrical punching rod 223 connected to the lower portion of the top surface plate 221; and an urging member 224 that urges the punching portion 220 upward. The punching blade 222 is formed, as a punch blade, at the head (lower end) of the punching rod 223. The circumferential edge of the eccentric cam member 231 abuts the top surface of the top surface plate 221.

Figure 4:
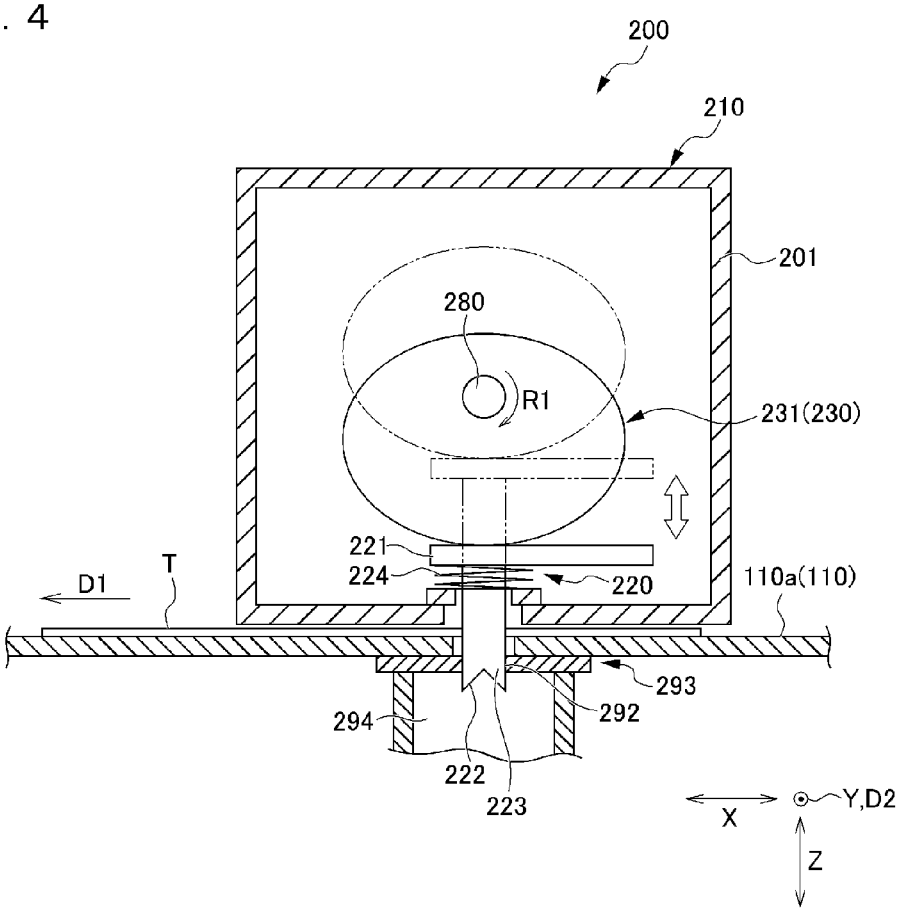
FIG. 4 illustrates the punching apparatus of the post-processing apparatus in the copy machine according to the embodiment, as viewed in the primary scanning direction.

As shown in FIG. 3 and FIG. 4, the blade receiver 293 is disposed below the punching blade 222 and below the paper sheet conveying path plate 110*a* of the second paper sheet conveying portion 110 when the punching blade 222 is at the punching reference position. The blade receiver 293 has a through hole 292 through which the punching blade 222 passes. The through hole 292 of the blade receiver 293 acts as a female part in the punching process, and is formed such that the punching blade 222 passes through the through hole 292 from above the through hole 292. The punching scrap storage portion 294 is formed immediately adjacent to the blade receiver 293, and is box-shaped. In the punching scrap storage portion 294, punching scraps of the paper sheets T are stored after the punching process by the punching blade 222.

As shown in FIG. 3 and FIG. 4, the converting mechanism 230 is disposed on and above the punching portions 220. The converting mechanism 230 has a pair of the eccentric cam members 231, 231 as a rotation member. The paired eccentric cam members 231, 231 are spaced from each other in the paper sheet width direction D2. Each eccentric cam member 231 has a plate-like shape having a curved circumferential edge.

As shown in FIG. 4, the pair of the eccentric cam members 231, 231 are structured so as to be rotatable in a first rotation direction R1. Each eccentric cam member 231 is shaped in a cam having an eccentric center of rotation such that a distance from the center of rotation to the circumferential edge that abuts the top surface (described below) of the top surface plate 221 of the punching portion 220 is different depending on a rotational position. In the present embodiment, each eccentric cam member 231 is formed in an ellipsoidal shape. The paired eccentric cam members 231, 231 are formed in the same shape.

A punching shaft 280 passes through the eccentric cam members 231 at the center of rotation of the eccentric cam members 231. The paired eccentric cam members 231, 231 are fixed to the punching shaft 280 so as to have the same shape and the same eccentric state as viewed in the axial direction of the punching shaft 280. Each eccentric cam member 231 rotates by the punching shaft 280 being rotated about the center of rotation in the first rotation direction by means of the cam rotation portion 240.

Each eccentric cam member 231 rotates with the eccentric cam member 231 abutting the top surface of the top surface plate 221 of the punching portion 220 described below, thereby moving the punching portion 220 (the punching blade 222) in the up-down direction Z. The converting mechanism 230 having the structure described above, converts rotational movements of the pair of eccentric cam members 231, 231 in the first rotation direction R1, to reciprocating movements of the punching blades 222 between the punching reference position and a through hole punching position.

As shown in FIG. 3, the cam rotation portion 240 includes a punching rotation motor 242 as a rotation driving portion, and a gear mechanism 243. The punching rotation motor 242 is implemented as, for example, a stepping motor. Further, the gear mechanism 243 includes, for example, a first gear 244 connected to an output shaft 241 of the punching rotation motor 242, and a second gear 245 that meshes with the first gear 244.

The cam rotation portion 240 drives rotation of the punching shaft 280 by transmitting a rotation driving force from the punching rotation motor 242 through the gear mechanism 243. The punching shaft 280 driven so as to rotate by the cam rotation portion 240 rotates each eccentric cam member 231. Thus, the punching rotation motor 242 drives the rotation of each eccentric cam member 231. Each eccentric cam member 231 is rotated through the punching shaft 280 that is driven to rotate by the cam rotation portion 240, so that the punching blades 222 reciprocate in the up-down direction Z. Thus, the punching blades 222 are movable between the punching reference position (see FIG. 6A) that is spaced from the paper sheet T, and the through hole punching position (see FIG. 6B) at which the paper sheet T is penetrated.

Figure 6A:
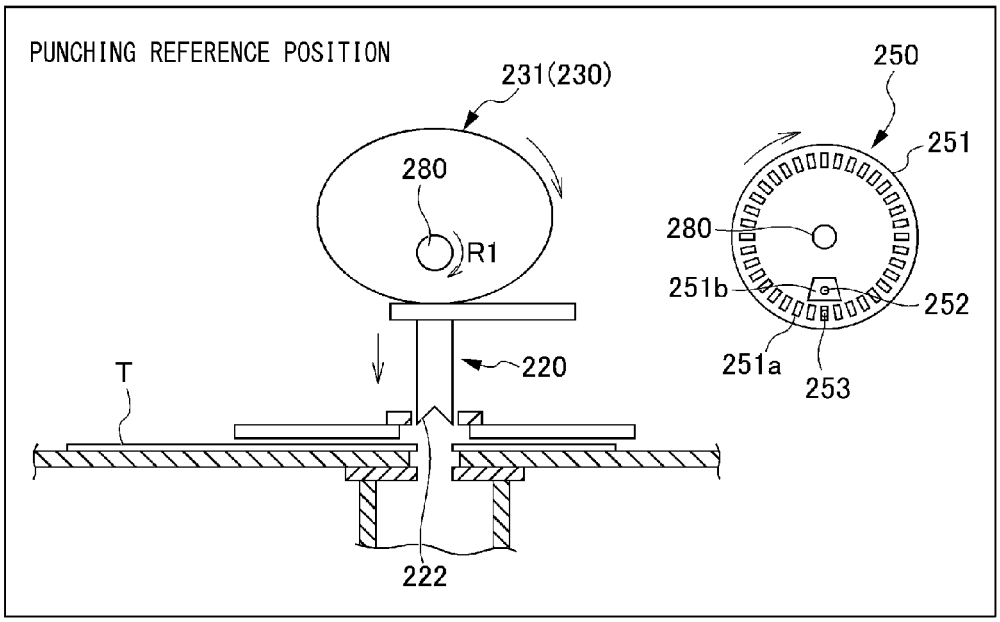
FIG. 6A shows a case where a punching blade of the punching apparatus according to the embodiment is at a punching reference position.

The punching reference position of the punching blade 222 is a position at which the punching blade 222 is sufficiently distant from the paper sheet T. When the punching blade 222 is at the punching reference position, the punching blade 222 does not contact with the paper sheet T. As shown in FIG. 6A, at the punching reference position of the punching blade 222, a portion, of the circumferential edge of the eccentric cam member 231, closest to the center of rotation abuts the top surface plate 221 of the punching portion 220.

Figure 6B:
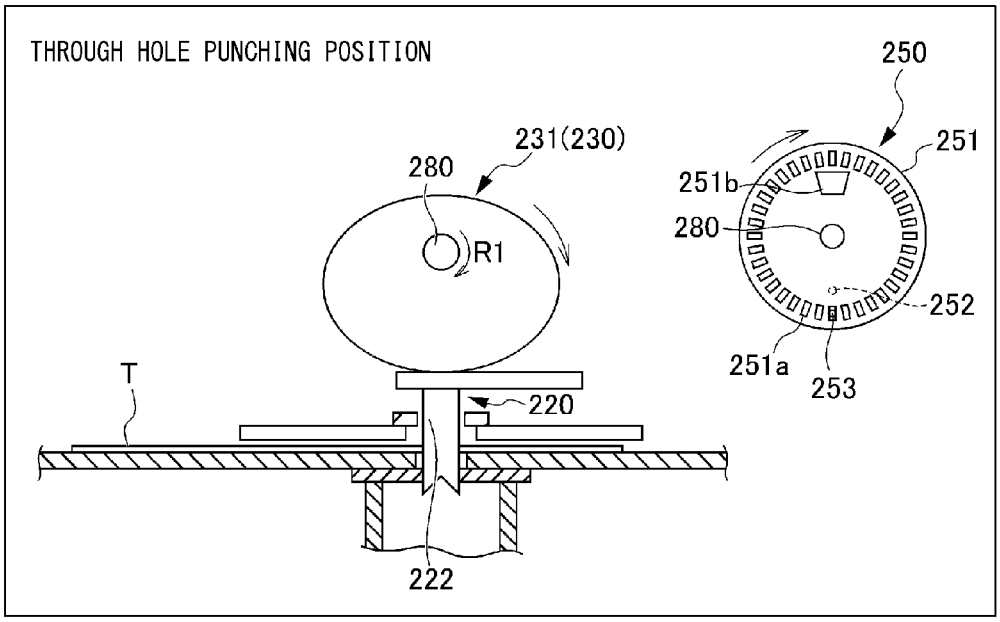
FIG. 6B shows a case where the punching blade of the punching apparatus according to the embodiment is at a through hole punching position.

Further, the through hole punching position of the punching blade 222 is a position at which the punching blade 222 penetrates through the paper sheet T. As shown in FIG. 6B, at the through hole punching position of the punching blade 222, a portion, of the circumferential edge of the eccentric cam member 231, farther from the center of rotation than the circumferential edge portion that abuts the top surface plate 221 when the punching blade 222 is at the punching reference position, abuts the top surface plate 221 of the punching portion 220. In the present embodiment, the through hole punching position of the punching blade is a position obtained by rotating the eccentric cam member 231 by 180 degrees in the first rotation direction R1 in a state where the punching blade 222 is at the punching reference position.

An operation in which the punching blade 222 is moved from the punching reference position to the through hole punching position, to perform the punching process for the paper sheet T, and an operation in which the punching blade 222 is moved from the through hole punching position to a punching reference position after completion of the punching process, will be briefly described. Firstly, an operation in which the punching blade 222 is moved from the punching reference position to the through hole punching position to perform the punching process for the paper sheet T will be described. In a state where the punching blade 222 is at the punching reference position (see FIG. 6A), the cam rotation portion 240 is driven to rotate the eccentric cam member 231 by 180 degrees in the first rotation direction R1. Thus, the eccentric cam member 231 is rotated from the punching reference position (see FIG. 6A) at which the portion of the circumferential edge closest to the center (shaft portion) of rotation abuts the top surface plate 221 of the punching portion 220, to the through hole punching position (see FIG. 6B) at which a portion of the circumferential edge farther from the center of rotation than the circumferential edge portion that abuts the top surface plate 221 when the punching blade 222 is at the punching reference position (see FIG. 6A), abuts the top surface plate 221 of the punching portion 220. Thus, the punching blade 222 is moved from the punching reference position (see FIG. 6A) to the through hole punching position (see FIG. 6B), whereby the punching blade 222 penetrates through the paper sheet T to form a punched hole.

Next, an operation in which the punching blade 222 is moved from the through hole punching position to the punching reference position after completion of the punching process, will be described. After completion of the punching process, in a state where the punching blade 222 is at the through hole punching position (see FIG. 6B), the cam rotation portion 240 is driven to rotate the eccentric cam member 231 by 180 degrees in the first rotation direction R1. Thus, the eccentric cam member 231 is rotated from the through hole punching position (see FIG. 6B) at which a portion of the circumferential edge farther from the center of rotation than the circumferential edge portion that abuts the top surface plate 221 when the punching blade 222 is at the punching reference position (see FIG. 6A), abuts the top surface plate 221 of the punching portion 220, to the punching reference position (see FIG. 6A) at which the portion of the circumferential edge closest to the center (shaft portion) of rotation abuts the top surface plate 221 of the punching portion 220. Thus, the punching blade 222 waits and prepares for the following punching process at the punching reference position (see FIG. 6A).

The punching blade 222 may move beyond the punching reference position when the punching blade 222 is returned to the punching reference position after the punching process. This is because, in a case where the punching blade 222 is returned from the through hole punching position to the punching reference position, even when the punching rotation motor 242 that rotates the eccentric cam member 231 is controlled so as to stop, the eccentric cam member 231 may rotate due to inertia, so that the punching blade 222 moves beyond the punching reference position toward the through hole punching position. Therefore, the punching blade 222 may move beyond the punching reference position when the punching blade 222 is returned to the punching reference position after the punching process, and may be positioned in a non-contact range (see FIG. 6C) or a contact range (see FIG. 6D)

Figure 6C:
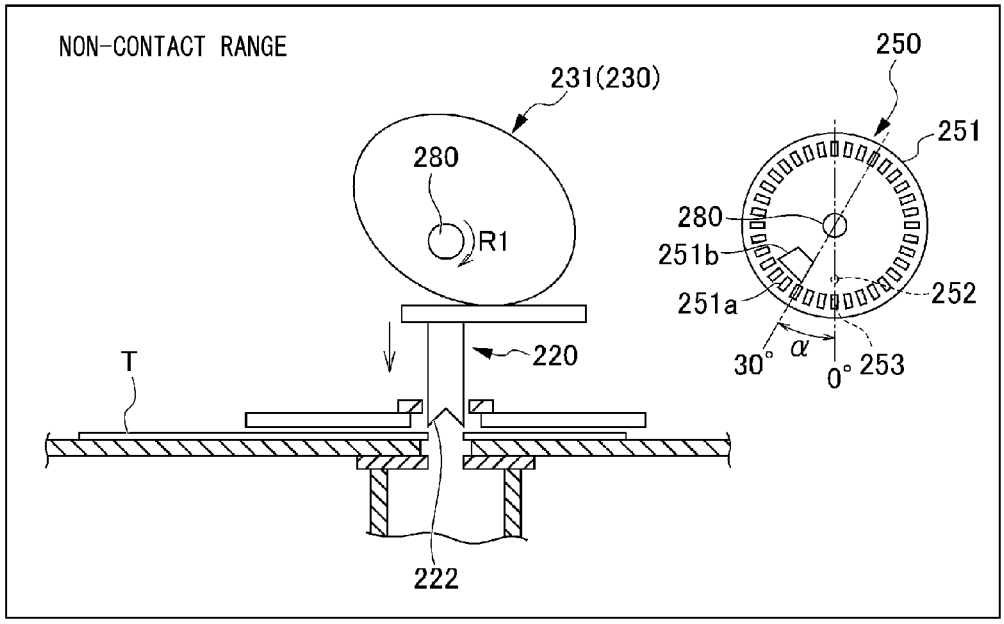
FIG. 6C shows a case where the punching blade of the punching apparatus according to the embodiment is positioned in a non-contact range.
Figure 6D:
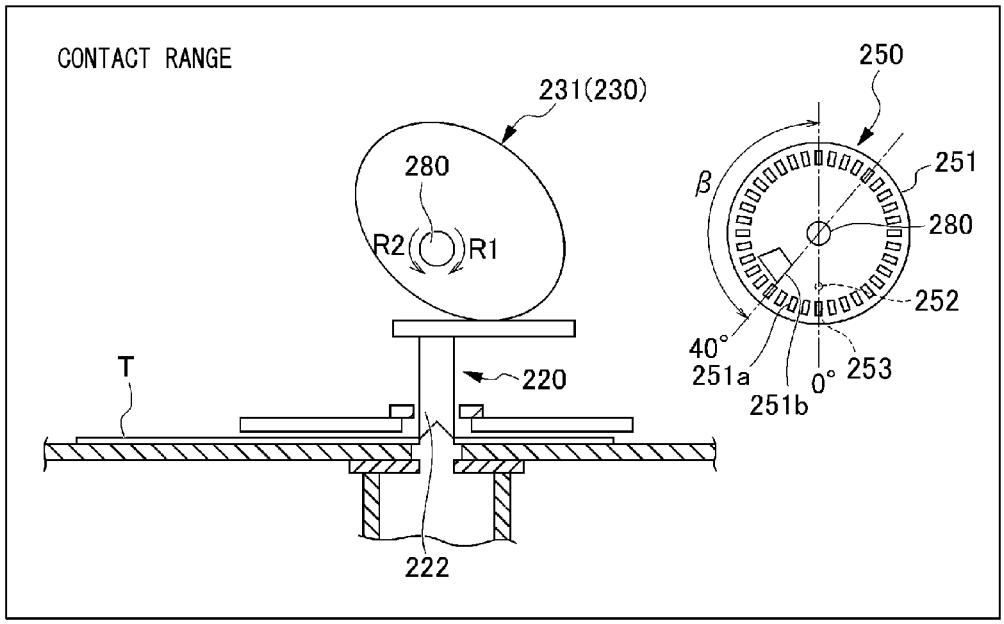
FIG. 6D shows a case where the punching blade of the punching apparatus according to the embodiment is positioned in a contact range.

The non-contact range for the punching blade 222 is a range which is included in a range in which the punching blade 222 is moved, and in which the punching blade 222 does not contact with the paper sheet T, as shown in FIG. 6C. In a case where the punching blade 222 is positioned in the non-contact range, even when the punching blade 222 is moved in the paper sheet width direction D2 by the paper sheet width direction movement portion 270, the paper sheet T is not damaged. The contact range for the punching blade 222 is a range which is included in the range in which the punching blade 222 is moved, and in which the punching blade 222 contacts with the paper sheet T, as shown in FIG. 6D. In a case where the punching blade 222 is positioned in the contact range, when the punching blade 222 is moved in the paper sheet width direction D2 by the paper sheet width direction movement portion 270, the paper sheet T may be damaged by the punching blade 222.

In a case where the punching blade 222 is returned from the through hole punching position to the punching reference position, when a moving distance of the punching blade 222 from the punching reference position is in a predetermined range, the punching blade 222 is positioned in the non-contact range. In the present embodiment, when, for example, a moving distance of the punching blade 222 from the punching reference position is in range in which a rotation angle of the eccentric cam member 231 (disk-having-slits which is denoted by 251) is less than or equal to 35 degrees, the punching blade 222 is positioned in the non-contact range.

On the other hand, in a case where the punching blade 222 is returned from the through hole punching position to the punching reference position, when a moving distance of the punching blade 222 from the punching reference position is not in the predetermined range, the punching blade 222 is positioned in the contact range. In the present embodiment, when, for example, a moving distance of the punching blade 222 from the punching reference position is in a range in which a rotation angle of the eccentric cam member 231 (disk 251 having slits) is greater than 35 degrees, the punching blade 222 is positioned in the contact range.

In the present embodiment, in a range from the punching reference position to positions at which a rotation angle of the eccentric cam member 231 (disk 251 having slits) is less than or equal to 35 degrees in the first rotation direction R1, the punching blade 222 does not contact with the paper sheet T. However, the present disclosure is not limited thereto. The range in which the punching blade 222 does not contact with the paper sheet T can be determined as appropriate according to a shape or the like of the eccentric cam member 231 being changed.

The rotational position detection portion 250 is disposed in one end portion of the punching shaft 280. The rotational position detection portion 250 is a detection portion that detects a rotational position of the eccentric cam member 231 (determines whether or not the eccentric cam member 231 is at a position corresponding to the punching reference position, and detects a rotational displacement). The rotational position detection portion 250 includes the disk 251 having slits, a reference position detection sensor (reference position detection portion) 252 having a light emitting element 252A and a light receiving element 252B, and a rotation amount detection sensor (rotation amount detection portion) 253 having a light emitting element 253A and a light receiving element 253B. The reference position detection sensor 252 and the rotation amount detection sensor 253 are implemented as, for example, a light transmitting photointerrupter.

Figure 5:
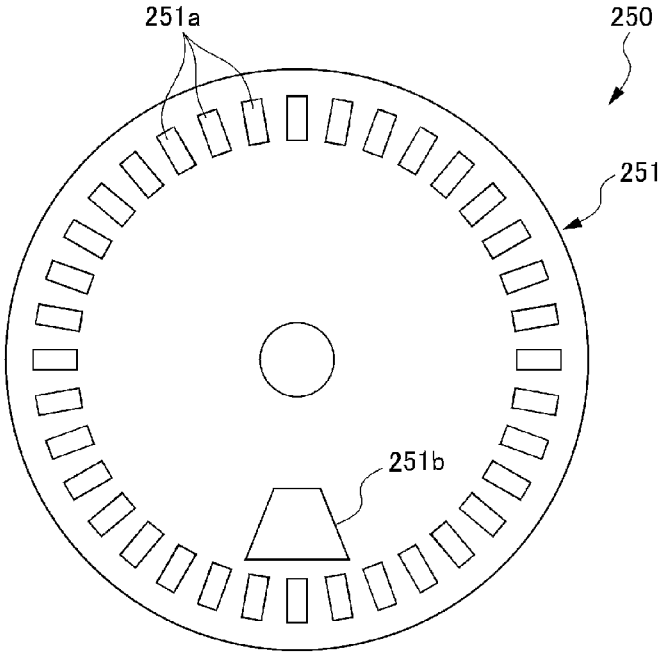
FIG. 5 illustrates a structure of a disk having slits in a rotational position detection portion according to the embodiment.

As shown in FIG. 3, the disk 251 having slits is fixed in the one end portion of the punching shaft 280. As shown in FIG. 5, the disk 251 having slits is circular-plate-shaped. At the center (mid-portion) of the disk 251 having slits, the punching shaft 280 passes through the disk 251. As shown in FIG. 5, the disk 251 having slits includes a reference position detection hole 251*b* and a plurality of slit-shaped holes 251*a*.

The reference position detection hole 251*b* is formed on the inner side of the disk 251 having slits. The reference position detection hole 251*b* is formed, as a through hole that has an almost trapezoidal shape, over an angular range corresponding to about three slit-shaped holes 251*a* formed on the outer circumferential side as described below.

The reference position detection sensor 252 can be used to determine whether the punching blade 222 is at the punching reference position or the punching blade 222 is not at the punching reference position, in the up-down direction Z in which the punching blade 222 is moved. The reference position detection sensor 252 is disposed so as to oppose a rotation trajectory of the reference position detection hole 251*b*. The reference position detection sensor 252 applies light to the rotation trajectory of the reference position detection hole 251*b* formed in the disk 251 having slits, and outputs a pulse according to whether the applied light passes through the reference position detection hole 251*b*, or the applied light is blocked.

The plurality of slit-shaped holes 251*a* are formed as 36 slit-shaped holes 251*a* each having a thin width, and are disposed on the outer circumferential side of the disk 251 having slits. The 36 slit-shaped holes 251*a* are formed as through holes that are aligned in the circumferential direction over a range corresponding to the entirety of the circumference of the disk 251 having slits, so as to be equally spaced from each other.

The rotation amount detection sensor 253 detects an amount of rotational movement of the eccentric cam member 231. The rotation amount detection sensor 253 is disposed so as to oppose a rotation trajectory of the plurality of slit-shaped holes 251*a*. The rotation amount detection sensor 253 applies light to the rotation trajectory of the plurality of slit-shaped holes 251*a* formed in the disk 251 having slits, and outputs a pulse according to whether the applied light passes through the slit-shaped holes 251*a* or the applied light is blocked.

In the present embodiment, the rotation amount detection sensor 253 detects 36 pulses corresponding to the number of the slit-shaped holes 251*a* when the disk 251 having slits has rotated 360 degrees. In other words, the rotation amount detection sensor 253 detects one pulse when the disk 251 having slits rotates 10 degrees.

The paper sheet conveying direction head detection portion 291 is implemented as, for example, a light sensor that detects the paper sheet T. The paper sheet conveying direction head detection portion 291 detects the head of the paper sheet T when light applied by the light sensor is blocked by the head, in the conveying direction D1, of the paper sheet T, in a case where the paper sheet T conveyed by the second paper sheet conveying portion 110 is below the paper sheet conveying direction head detection portion 291.

The paper sheet width direction end detection portion 260 is disposed in the punching unit 210. The paper sheet width direction end detection portion 260 detects a position of the end, in the paper sheet width direction D2, of the paper sheet T. The paper sheet width direction end detection portion 260 is implemented as, for example, a light sensor that detects the paper sheet T. The paper sheet width direction end detection portion 260 detects the end, in the paper sheet width direction D2, of the paper sheet T when the light applied by the light sensor is blocked by the end portion, in the paper sheet width direction D2, of the paper sheet T due to the punching unit 210 being moved in the paper sheet width direction D2.

Figure 7:
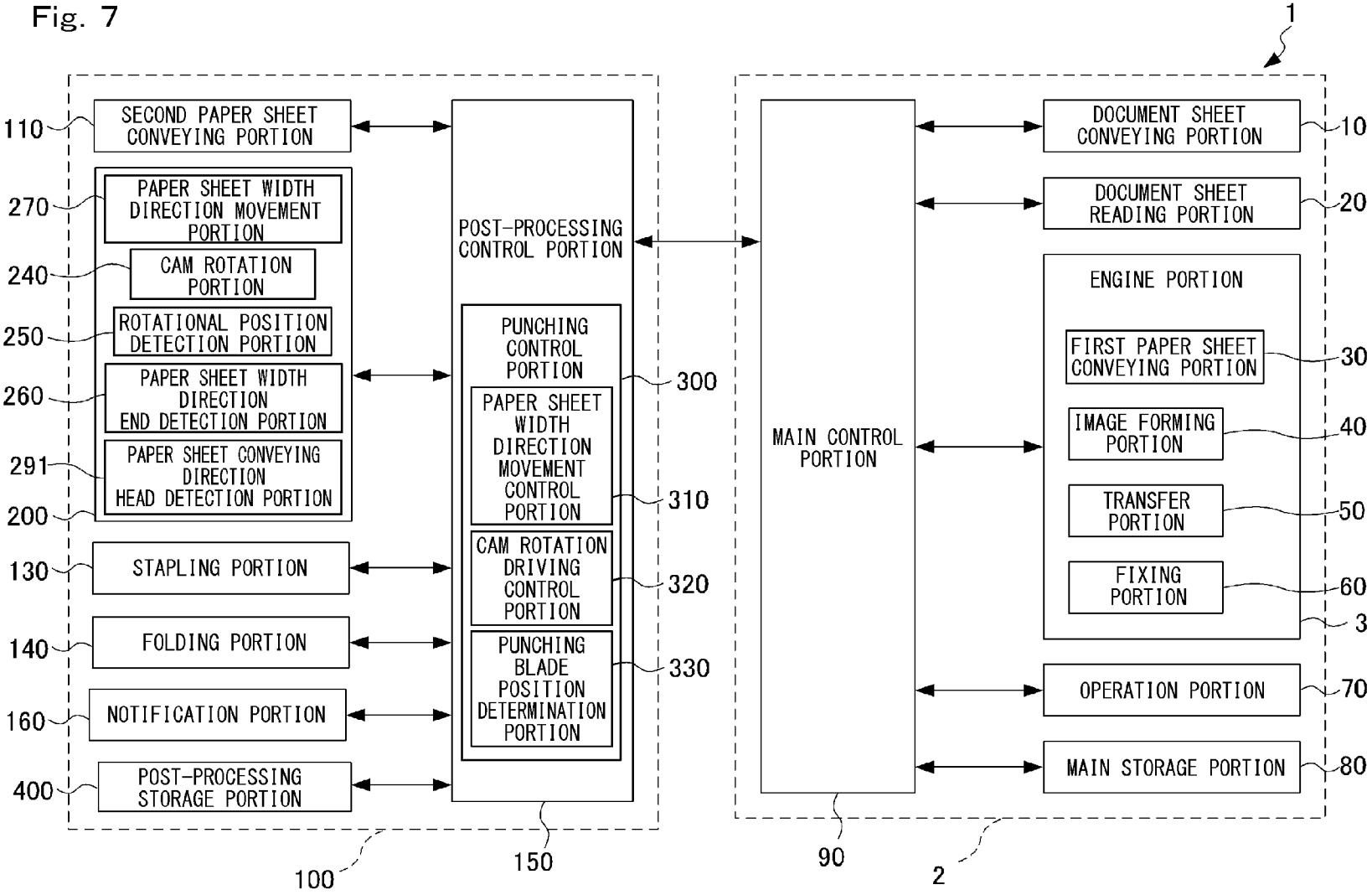
FIG. 7 is a block diagram illustrating a functional configuration of the copy machine.

Next, a functional configuration of the copy machine 1 will be described. FIG. 7 is a block diagram illustrating a functional configuration of the copy machine 1. The copy machine body 2 includes the aforementioned components (the document sheet conveying portion 10, the document sheet reading portion 20, the first paper sheet conveying portion 30, the image forming portion 40, the transfer portion 50, and the fixing portion 60). An engine portion 3 is formed by the first paper sheet conveying portion 30, the image forming portion 40, the transfer portion 50, and the fixing portion 60. Description of the components described with reference to FIG. 1 is not given. Further, the copy machine body 2 includes an operation portion 70, a main storage portion 80, and a main control portion 90, in addition to the functional components described above.

The operation portion 70 includes a numerical keypad (not shown), a touch panel (not shown), a start key (not shown), and the like. The numerical keypad is operated so as to input numbers such as the number of copies to be printed. On the touch panel, for example, a plurality of keys assigned various functions (for example, a function of setting a printing magnification, a function of allocating a plurality of pages to one paper sheet T (2 in 1 or the like), functions of executing the punching process, the stapling process, or the folding process), are indicated. One of the keys indicated on the touch panel is operated (touched) in order to cause the copy machine 1 to execute a corresponding one of various functions. The start key is operated so as to execute printing. The operation portion 70 supplies, when one of the keys is operated, a signal indicating that the one of the keys is operated, to the main control portion 90.

The main storage portion 80 is implemented as a hard disk, a semiconductor memory, or the like. In the main storage portion 80, image data based on the document sheet G read by the document sheet reading portion 20 is stored. Further, in the main storage portion 80, a control program used in the copy machine 1, data used by the control program, and the like are stored.

The main control portion 90 controls the document sheet conveying portion 10, the document sheet reading portion 20, the engine portion 3, the touch panel of the operation portion 70, and a post-processing control portion 150.

The post-processing apparatus 100 includes the aforementioned components (the second paper sheet conveying portion 110, the punching apparatus 200, the stapling portion 130, and the folding portion 140). Description of the components described with reference to FIG. 1 is not given. Further, the post-processing apparatus 100 includes a notification portion 160 and the post-processing control portion 150, in addition to the components described above. The notification portion 160 makes notification under the control of the post-processing control portion 150. Specifically, the notification by the notification portion 160 is made by, for example, outputting sound from a speaker (not shown), or indicating warning on the touch panel.

The main control portion 90 controls the post-processing control portion 150 so as to perform post-processing for the paper sheet T discharged from the second paper sheet discharge portion 38. The post-processing control portion 150 causes the second paper sheet conveying portion 110 to convey, into the post-processing apparatus 100, the paper sheet T discharged from the second paper sheet discharge portion 38.

The post-processing control portion 150 includes a punching control portion 300 and a post-processing storage portion 400. The punching control portion 300 performs control so as to execute the punching process in which punched holes are formed in the paper sheet T. The punching control portion 300 includes a paper sheet width direction movement control portion (orthogonal direction movement control portion) 310, a cam rotation driving control portion (rotation driving control portion) 320, and a punching blade position determination portion 330.

The paper sheet width direction movement control portion 310 controls the paper sheet width direction movement portion 270 so as to move the punching unit 210 (the punching blade 222) in the paper sheet width direction D2. The paper sheet width direction movement control portion 310 controls the paper sheet width direction movement portion 270 so as to move the punching unit 210 (the punching blade 222) to the punching reference position in the paper sheet width direction D2, based on positional information about the end, in the paper sheet width direction D2, of the paper sheet T, which is detected by the paper sheet width direction end detection portion 260.

The paper sheet width direction movement control portion 310 controls the paper sheet width direction movement portion 270 so as to move the punching unit 210 (the punching blade 222) to the paper sheet width direction waiting position when the cam rotation driving control portion 320 causes the punching rotation motor 242 to rotate the eccentric cam member 231 in a second rotation direction R2 such that the punching blade 222 is moved toward the punching reference position. The paper sheet width direction movement control portion 310 controls the paper sheet width direction movement portion 270 so as to move the punching unit 210 (the punching blade 222) to the paper sheet width direction waiting position when the punching blade position determination portion 330 determines that a moving distance of the punching blade 222 from the punching reference position is in a predetermined range. The paper sheet width direction movement control portion 310 controls the paper sheet width direction movement portion 270 so as to move the punching unit 210 (the punching blade 222) to the paper sheet width direction waiting position when the punching blade position determination portion 330 determines that a moving distance of the punching blade 222 from the punching reference position is in a predetermined range in a case where the cam rotation driving control portion 320 causes the punching rotation motor 242 to maintain rotation of the eccentric cam member 231 in the second rotation direction R2.

The cam rotation driving control portion 320 controls the punching rotation motor 242 so as to rotate the eccentric cam member 231 in the first rotation direction R1 such that the punching blade 222 is moved from the punching reference position to the through hole punching position. The cam rotation driving control portion 320 controls the punching rotation motor 242 so as to stop rotating the eccentric cam member 231 such that the punching blade 222 is moved from the through hole punching position to the punching reference position to stop at the punching reference position.

The cam rotation driving control portion 320 controls the punching rotation motor 242 so as to rotate the eccentric cam member 231 in the second rotation direction R2 opposite to the first rotation direction R1 such that the punching blade 222 is moved toward the punching reference position, in a case where the punching rotation motor 242 is caused to stop rotating the eccentric cam member 231 so as to stop the punching blade 222 at the punching reference position, and the reference position detection sensor 252 determines that the punching blade 222 has moved beyond the punching reference position toward the through hole punching position. The cam rotation driving control portion 320 controls the punching rotation motor 242 so as to maintain rotation of the eccentric cam member 231 in the second rotation direction R2 such that the punching blade 222 is moved toward the punching reference position, in a case where the punching blade position determination portion 330 described below determines that a moving distance of the punching blade 222 from the punching reference position is not in a predetermined range.

The punching blade position determination portion 330 determines whether or not a moving distance of the punching blade 222 from the punching reference position is in a predetermine range, with reference to information stored in the post-processing storage portion 400 described below, based on reference position information, for the punching blade 222, detected by the reference position detection sensor 252, and an amount of rotational movement, of the eccentric cam member 231, detected by the rotation amount detection sensor 253. The predetermined range used by the punching blade position determination portion 330 for determination for a moving distance of the punching blade 222 from the punching reference position is a range in which the punching blade 222 does not contact with the paper sheet T.

The punching blade position determination portion 330 is allowed to determine whether the punching blade 222 is in the non-contact range or the contact range, according to the number of pulses that is based on the slit-shaped holes 251*a* and is detected by the rotation amount detection sensor 253. In the present embodiment, as described above, when a moving distance of the punching blade 222 from the punching reference position is in a range in which a rotation angle of the eccentric cam member 231 (the disk 251 having slits) is less than or equal to 35 degrees, the punching blade 222 is positioned in the non-contact range. On the other hand, when a moving distance of the punching blade 222 from the punching reference position is in a range in which a rotation angle of the eccentric cam member 231 (the disk 251 having slits) is greater than 35 degrees, the punching blade 222 is positioned at the contact range. Further, in the present embodiment, the rotational position of the disk 251 having slits can be detected at 10 degree intervals due to 36 slit-shaped holes 251*a* being formed.

Therefore, as shown in FIG. 6C, when the rotation amount detection sensor 253 determines that a moving distance from the punching reference position (see FIG. 6A) is in an angular range (α) in which a rotation angle of the eccentric cam member 231 (the disk 251 having slits) is less than or equal to 30 degrees in the first rotation direction R1, it can be determined that the punching blade 222 is positioned in the non-contact range. On the other hand, as shown in FIG. 6D, when the rotation amount detection sensor 253 determines that a moving distance from the punching reference position (see FIG. 6A) is in an angular range (β) in which a rotation angle of the eccentric cam member 231 (the disk 251 having slits) is greater than or equal to 40 degrees in the first rotation direction R1, it can be determined that the punching blade 222 is positioned in the contact range.

The post-processing storage portion 400 stores the non-contact range in which the punching blade 222 does not contact with the paper sheet T, as the number of pulses which is detected, based on the plurality of slit-shaped holes 251*a*, as a moving distance from the reference position detection hole 251*b*, according to types, such as shapes, of the eccentric cam member 231. In the present embodiment, the angular range (α) where a moving distance from the punching reference position (see FIG. 6A) is in a range in which a rotation angle of the eccentric cam member 231 (the disk 251 having slits) is less than or equal to 30 degrees in the first rotation direction R1, is set as the non-contact range. Therefore, the post-processing storage portion 400 stores information indicating that the punching blade 222 is in the non-contact range when the number of pulses corresponding to the slit-shaped holes 251*a* from the reference position detection hole 251*b* is less than or equal to three, so as to associate the non-contact range of the punching blade 222 with the angular range (α) in which a rotation angle of the eccentric cam member 231 (the disk 251 having slits) is less than or equal to 30 degrees in the first rotation direction R1, as shown in FIG. 6C.

Further, the post-processing storage portion 400 stores the contact range in which the punching blade 222 contacts with the paper sheet T, as the number of pulses which is detected, based on the plurality of slit-shaped holes 251*a*, as a moving distance from the reference position detection hole 251*b*, according to types, such as shapes, of the eccentric cam member 231. In the present embodiment, the angular range (β) where a moving distance from the punching reference position (see FIG. 6A) is in a range in which a rotation angle of the eccentric cam member 231 (the disk 251 having slits) is greater than or equal to 40 degrees in the first rotation direction R1, is set as the contact range. Therefore, the post-processing storage portion 400 stores information indicating that the punching blade 222 is in the contact range when the number of pulses corresponding to the slit-shaped holes 251*a* from the reference position detection hole 251*b* is greater than or equal to four, so as to associate the contact range of the punching blade 222 with the angular range (β) in which a rotation angle of the eccentric cam member 231 (the disk 251 having slits) is greater than or equal to 40 degrees in the first rotation direction R1, as shown in FIG. 6D.

Figure 8A:
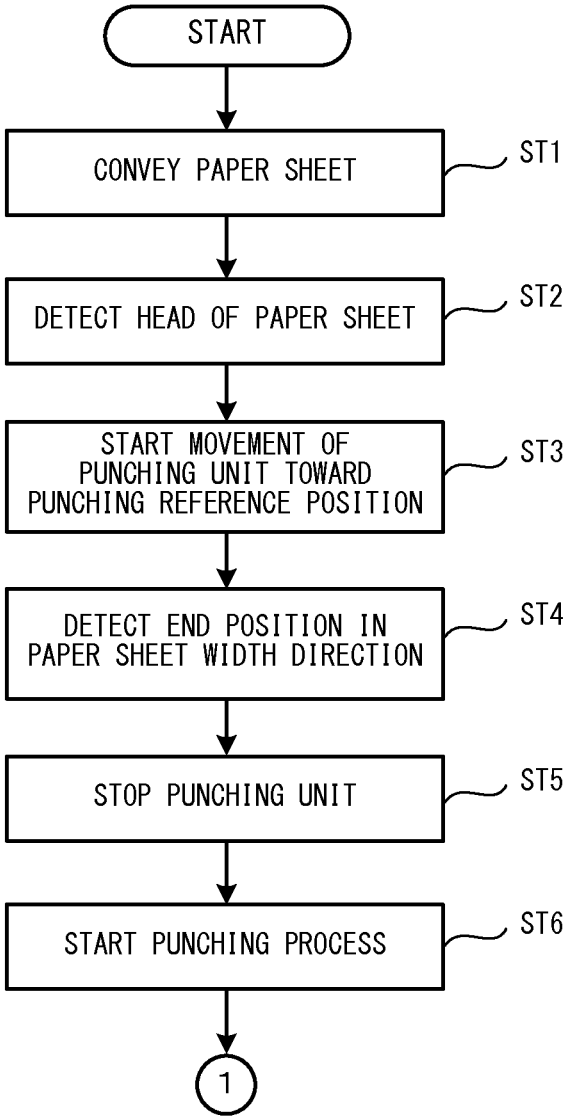
FIG. 8A is a flow chart showing an operation of the post-processing apparatus.
Figure 8B:
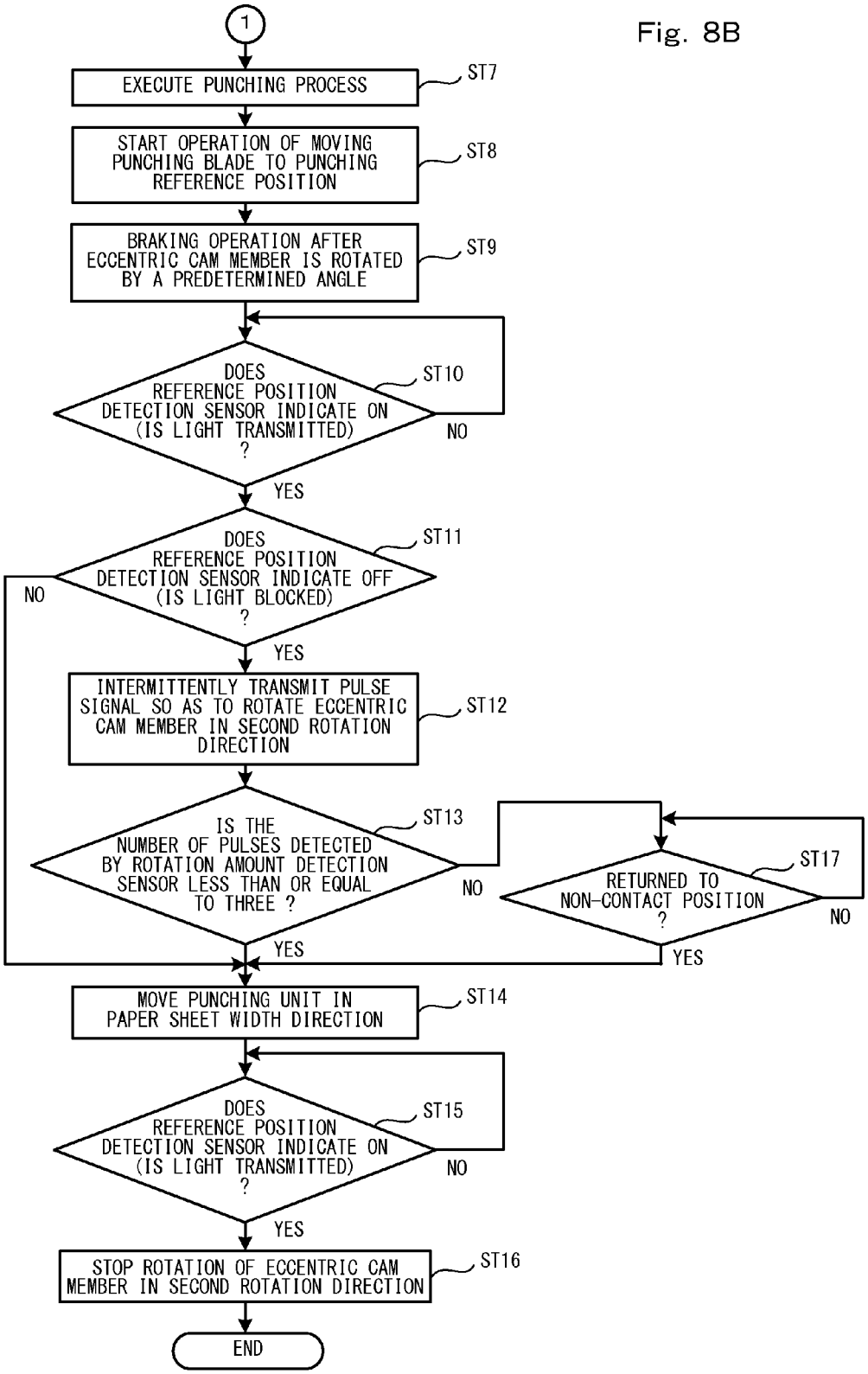
FIG. 8B is a flow chart showing an operation of the post-processing apparatus.
Figure 9A:
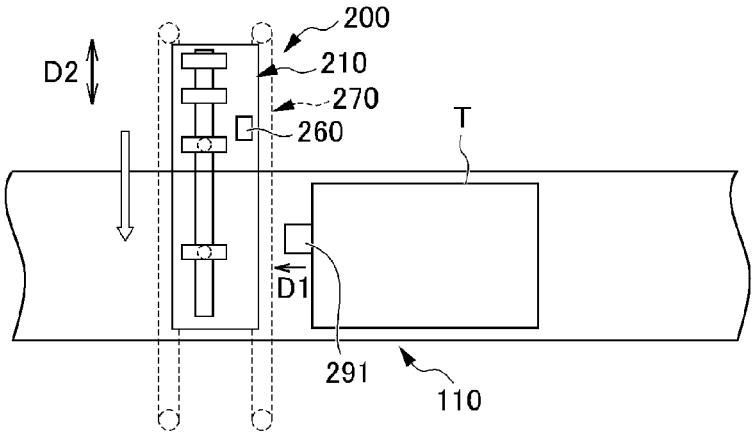
FIG. 9A illustrates an operation of a punching unit moving from a paper sheet width direction waiting position to the punching reference position in a paper sheet width direction, and illustrates a state where the head of a paper sheet is detected by a paper sheet conveying direction head detection portion.
Figure 9B:
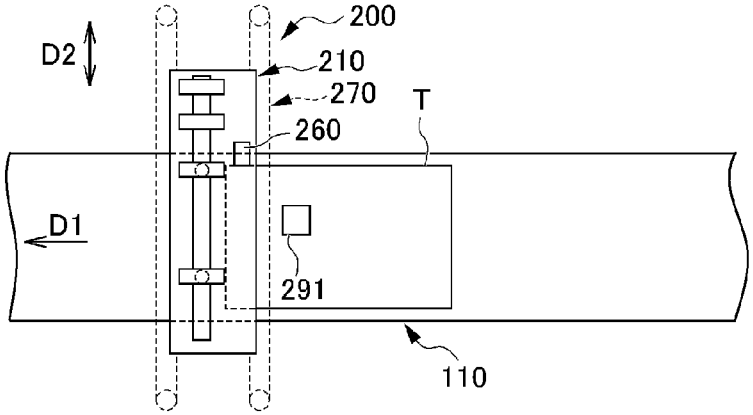
FIG. 9B illustrates an operation of the punching unit moving from the paper sheet width direction waiting position to a width direction punching position in the paper sheet width direction, and illustrates a state where the end, in the paper sheet width direction, of a paper sheet T is detected by a paper sheet width direction end detection portion.
Figure 9C:
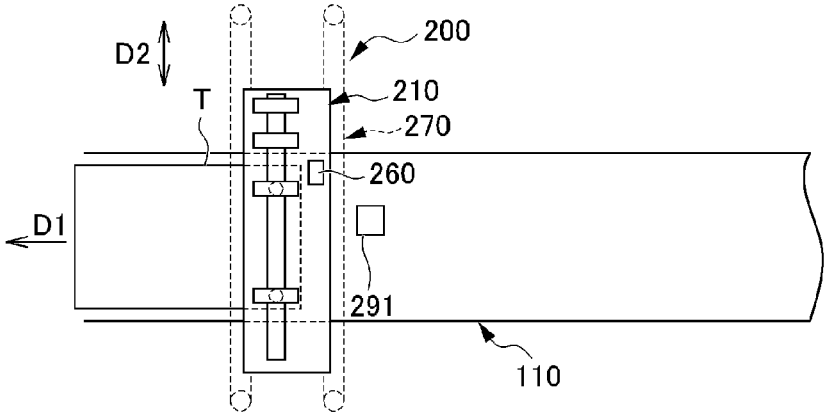
FIG. 9C illustrates an operation of the punching unit moving from the paper sheet width direction waiting position to the width direction punching position in the paper sheet width direction, and illustrates a state where the punching unit is at the punching reference position.
Figure 10:
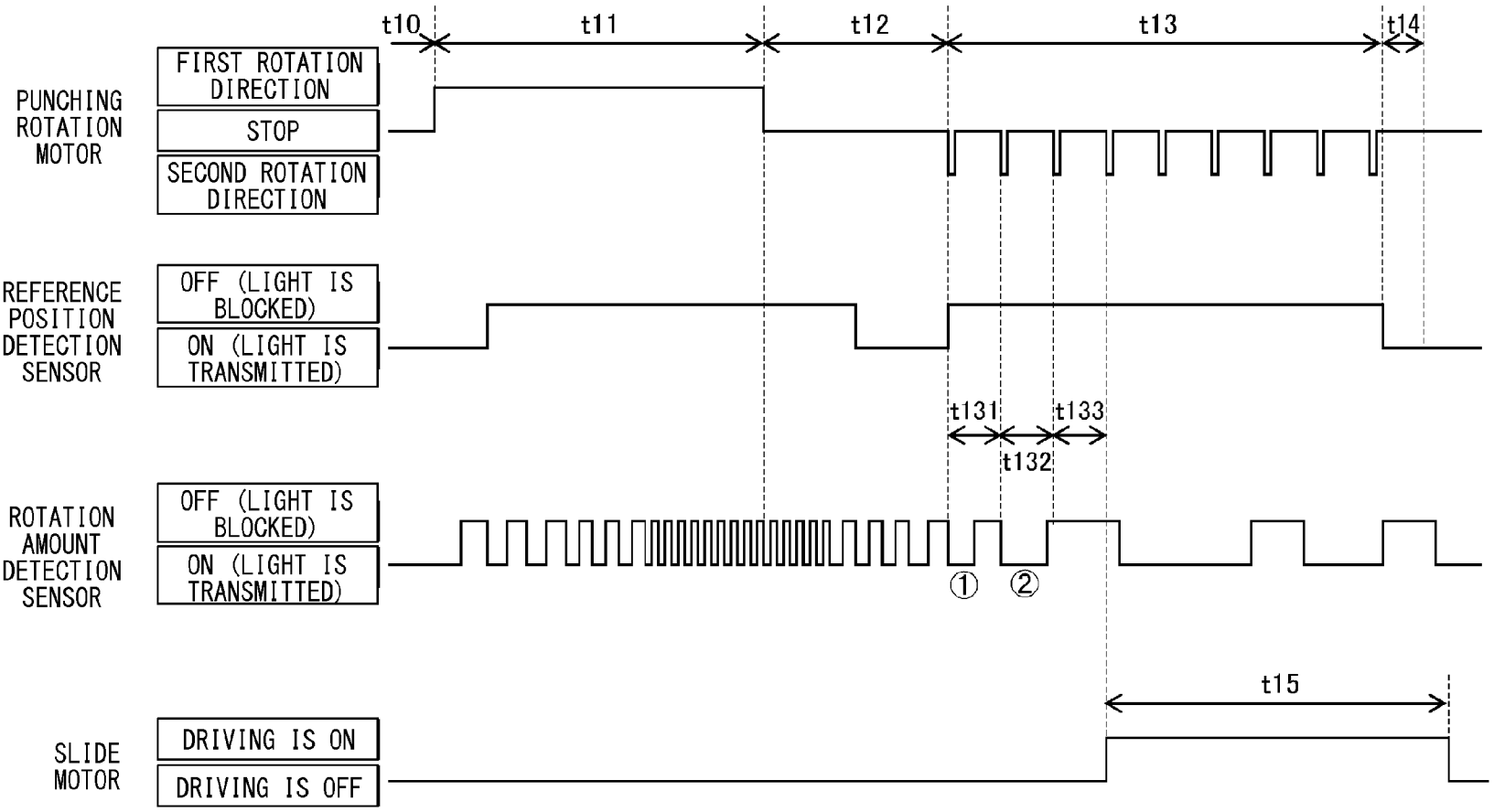
FIG. 10 is a timing chart showing an operation performed by the punching apparatus when the punching blade moves beyond the punching reference position and stops in the non-contact range.
Figure 11:
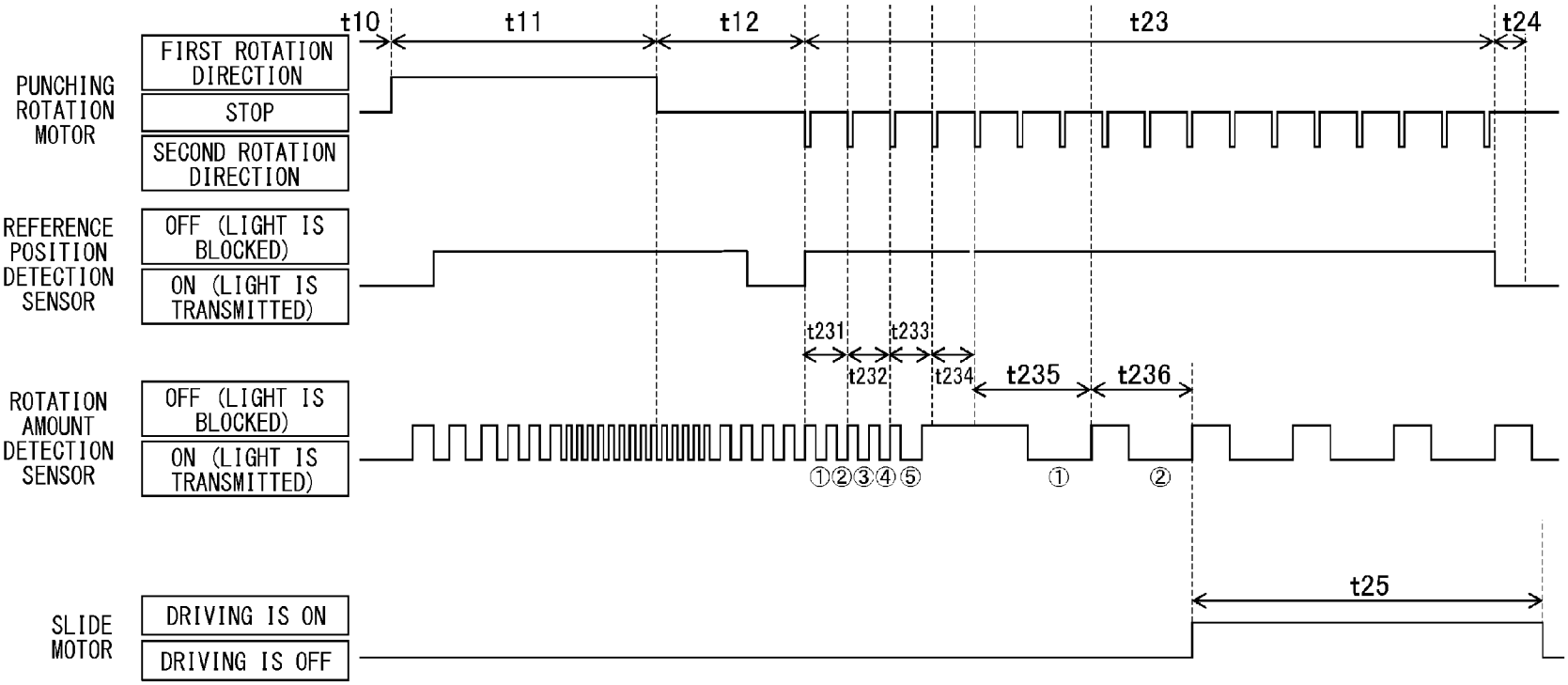
FIG. 11 is a timing chart showing an operation performed by the punching apparatus when the punching blade moves beyond the punching reference position and stops in the contact range.

Next, an operation of the punching process by the punching apparatus 200 in the post-processing apparatus 100 will be described with reference to the drawings. FIG. 8A is a flow chart showing an operation of the post-processing apparatus 100. FIG. 8B is a flow chart showing an operation of the post-processing apparatus 100. FIG. 9A illustrates an operation of the punching unit 210 moving from the paper sheet width direction waiting position to the punching reference position in the paper sheet width direction D2, and illustrates a state where the head of the paper sheet T is detected by the paper sheet conveying direction head detection portion 291. FIG. 9B illustrates an operation of the punching unit 210 moving from the paper sheet width direction waiting position to the width direction punching position in the paper sheet width direction D2, and illustrates a state where the end, in the paper sheet width direction D2, of the paper sheet T is detected by the paper sheet width direction end detection portion 260. FIG. 9C illustrates an operation of the punching unit 210 moving from the paper sheet width direction waiting position to the width direction punching position in the paper sheet width direction D2, and illustrates a state where the punching unit 210 is at the punching reference position. FIG. 10 is a timing chart showing an operation performed by the punching apparatus 200 when the punching blade 222 moves beyond the punching reference position and stops in the non-contact range. FIG. 11 is a timing chart showing an operation performed by the punching apparatus 200 when the punching blade 222 moves beyond the punching reference position and stops in the contact range.

Firstly, before the punching apparatus 200 performs the punching process, the punching unit 210 is positioned at the paper sheet width direction waiting position in the paper sheet width direction D2. As shown in FIG. 10 and FIG. 11, when the punching blade 222 is at the punching reference position, a signal detected by the reference position detection sensor 252 indicates ON (light is transmitted), and when the punching blade 222 is not at the punching reference position, an output of a signal detected by the reference position detection sensor 252 indicates OFF (light is blocked). Further, in the present embodiment, the non-contact range for the punching blade 222 is a range in which a rotation angle of the eccentric cam member 231 from the punching reference position is less than or equal to 35 degrees. The contact range for the punching blade 222 is a range in which a rotation angle of the eccentric cam member 231 from the punching reference position is greater than 35 degrees.

In step ST1, the second paper sheet conveying portion 110 conveys the paper sheet T having been conveyed from the copy machine body 2. Until the head of the paper sheet T is detected by the paper sheet conveying direction head detection portion 291, the punching apparatus 200 is waiting for arrival of the paper sheet T conveyed by the second paper sheet conveying portion 110.

In step ST2, as shown in FIG. 9A, the paper sheet conveying direction head detection portion 291 detects the head of the paper sheet T. The paper sheet T is not stopped and is conveyed in the conveying direction D1 also after the head of the paper sheet T is detected by the paper sheet conveying direction head detection portion 291.

In step ST3, the paper sheet width direction movement control portion 310 controls the paper sheet width direction movement portion 270 so as to move the punching unit 210 toward the punching reference position in the paper sheet width direction D2 when a predetermined time elapses after the head of the paper sheet T is detected by the paper sheet conveying direction head detection portion 291.

In step ST4, as shown in FIG. 9B, the end, in the paper sheet width direction D2, of the paper sheet T is detected by the paper sheet width direction end detection portion 260.

In step ST5, the paper sheet width direction movement control portion 310 controls the paper sheet width direction movement portion 270 so as to stop the punching unit 210 at the punching reference position in the paper sheet width direction D2 when a predetermined time elapses after the end, in the paper sheet width direction D2, of the paper sheet T is detected by the paper sheet width direction end detection portion 260. Thus, as shown in FIG. 9C, the punching unit 210 is positioned at the punching reference position in the paper sheet width direction D2. Further, the punching control portion 300 controls the second paper sheet conveying portion 110 so as to stop the paper sheet T at a predetermined position in the conveying direction D1.

In step ST6, the punching apparatus 200 starts the punching process. Firstly, the punching blade 222 is at the punching reference position (see FIG. 6A).

In step ST7, the punching apparatus 200 executes the punching process. Specifically, the cam rotation driving control portion 320 controls the punching rotation motor 242 so as to move the punching blade 222 from the punching reference position (see FIG. 6A) to the through hole punching position (see FIG. 6B). Specifically, the cam rotation driving control portion 320 controls the punching rotation motor 242 so as to rotate the eccentric cam member 231 in the first rotation direction R1. Thus, the punching blade 222 is moved from the punching reference position to the through hole punching position, thereby forming punched holes in the paper sheet T.

In step ST8, since the punching process is completed, an operation of moving the punching blade 222 from the through hole punching position to the punching reference position is started. Specifically, the cam rotation driving control portion 320 controls the punching rotation motor 242 so as to move the punching blade 222 from the through hole punching position (see FIG. 6B) to the punching reference position (see FIG. 6A). Specifically, the cam rotation driving control portion 320 controls the punching rotation motor 242 so as to rotate the eccentric cam member 231 in the first rotation direction R1. Thus, the eccentric cam member 231 starts rotating in the first rotation direction R1 so as to return the punching blade 222 to the punching reference position. The operation of the punching apparatus 200 in step ST8 is executed by driving of the punching rotation motor 242 when time t10 shifts to time t11 in FIG. 10 and FIG. 11. In FIG. 10 and FIG. 11, timings for waveforms in a period from time t10 to time t12 are the same.

In step ST9, the punching rotation motor 242 is stopped so as to stop the punching blade 222 at the punching reference position. Specifically, the cam rotation driving control portion 320 controls the punching rotation motor 242 so as to stop the punching blade 222 at the punching reference position after the punching blade 222 has been moved from the through hole punching position (see FIG. 6B) to the punching reference position (see FIG. 6A). Specifically, the cam rotation driving control portion 320 controls the punching rotation motor 242 so as to stop rotating the eccentric cam member 231 after the eccentric cam member 231 has been rotated from the through hole punching position by a predetermined angle. The operation of the punching apparatus 200 in step ST9 is executed by the punching rotation motor 242 when time t11 shifts to time t12 in FIG. 10 and FIG. 11.

In step ST10, the reference position detection sensor 252 determines whether or not indication of a detected signal has changed from OFF (light is blocked) to ON (light is transmitted). Here, the reference position detection sensor 252 determines that the punching blade 222 is at the punching reference position. When indication of the signal detected by the reference position detection sensor 252 changes from OFF (light is blocked) to ON (light is transmitted) (YES), the punching blade 222 is at the punching reference position, whereby the process is advanced to step ST11. When the signal detected by the reference position detection sensor 252 still indicates OFF (light is blocked) (NO), the punching blade 222 is not at the punching reference position, whereby the process is returned to step ST10. The operation of the punching apparatus 200 in step ST10 is executed during time t12 in FIG. 10 and FIG. 11.

In step ST11, the reference position detection sensor 252 determines whether or not indication of the detected signal has changed from ON (light is transmitted) to OFF (light is blocked). Here, the reference position detection sensor 252 determines whether the punching blade 222 has stopped in a range of the punching reference position or the punching blade 222 has moved beyond the punching reference position, by determining whether the punching blade 222 is at the punching reference position or the punching blade 222 is not at the punching reference position. When indication of the signal detected by the reference position detection sensor 252 has changed from ON (light is transmitted) to OFF (light is blocked) (YES), the punching blade 222 is not at the punching reference position.

Therefore, it can be determined that the punching blade 222 has moved beyond the punching reference position, and the process is advanced to step ST12. When the reference position detection sensor 252 still detects ON (light is transmitted) (NO), the punching blade 222 is stationary at the punching reference position, whereby the process is advanced to step ST14. The operation of the punching apparatus 200 in step ST11 is executed at the end of time t12 in FIG. 10 and FIG. 11.

In step ST12, since the reference position detection sensor 252 determines that the punching blade 222 has moved beyond the punching reference position toward the through hole punching position, the cam rotation driving control portion 320 controls the punching rotation motor 242 so as to rotate the eccentric cam member 231 in the second rotation direction R2 opposite to the first rotation direction R1 such that the punching blade 222 is moved toward the punching reference position. Specifically, as shown in FIG. 10 and FIG. 11, the cam rotation driving control portion 320 intermittently transmits a pulse-like minus voltage signal at 8 ms intervals, thereby controlling the punching rotation motor 242 so as to rotate the eccentric cam member 231 in the second rotation direction R2. The intermittent transmission of the pulse-like minus voltage signal is continued until the punching blade 222 is moved to the punching reference position. The operation of the punching apparatus 200 in step ST12 is executed at time t13 in FIG. 10 and at time t23 in FIG. 11.

In step ST13, the punching blade position determination portion 330 determines whether or not a moving distance of the punching blade 222 from the punching reference position is in a predetermined range, with reference to the information stored in the post-processing storage portion 400, based on the reference position information, for the punching blade 222, detected by the reference position detection sensor 252, and an amount of rotational movement, of the eccentric cam member 231, detected by the rotation amount detection sensor 253. In this case, the predetermined range of the moving distance of the punching blade 222 from the punching reference position as determined by the punching blade position determination portion 330 is a range in which the punching blade 222 does not contact with the paper sheet T. Specifically, the punching blade position determination portion 330 determines whether the punching blade 222 is positioned in the non-contact range (see FIG. 6C) or in the contact range (see FIG. 6D) when the rotation of the eccentric cam member 231 is stopped.

Specifically, the reference position detection sensor 252 detects for a pulse corresponding to the punching reference position based on the reference position detection hole 251*b*. The rotation amount detection sensor 253 detects pulses corresponding to an amount of rotational movement based on the plurality of slit-shaped holes 251*a*. When the pulse detected by the rotation amount detection sensor 253 does not change, it can be determined that rotation of the disk 251 having slits is stopped, and rotation of the eccentric cam member 231 is stopped. In the present embodiment, at time t133 in FIG. 10 and at time t234 in FIG. 11, pulse waveform does not change between ON (light is transmitted) and OFF (light is blocked). Further, in the present embodiment, the post-processing storage portion 400 stores information indicating that the punching blade 222 is at the non-contact position when the number of pulses corresponding to the slit-shaped holes 251*a* from the reference position detection hole 251*b* is less than or equal to three (when an angle from the reference position detection hole 251*b* is less than or equal to 35 degrees), and stores information indicating that the punching blade 222 is at the contact position when the number of pulses corresponding to the slit-shaped holes 251*a* from the reference position detection hole 251*b* is greater than or equal to four (when an angle from the reference position detection hole 251*b* is greater than 35 degrees).

That is, in the present embodiment, when the number of pulses of a signal detected by the rotation amount detection sensor 253 is less than or equal to three, the punching blade 222 is positioned in the non-contact range (see FIG. 6C). On the other hand, when the number of pulses of a signal detected by the rotation amount detection sensor 253 is greater than or equal to four, the punching blade 222 is positioned in the contact range (see FIG. 6D). Thus, the punching blade position determination portion 330 determines whether or not number of pulses of a signal detected by the rotation amount detection sensor 253 is less than or equal to three, with reference to the information stored in the post-processing storage portion 400, based on the reference position information, for the punching blade 222, detected by the reference position detection sensor 252, and an amount of rotational movement, of the eccentric cam member 231, detected by the rotation amount detection sensor 253.

When the number of pulses of a signal detected by the rotation amount detection sensor 253 is less than or equal to three (YES), the punching blade 222 is positioned in the non-contact range, whereby the process is advanced to step ST14. The process is advanced from step ST13 to step ST14, in a period between time t131 to time t133 in FIG. 10. When the number of pulses of a signal detected by the rotation amount detection sensor 253 is greater than or equal to four (NO), the punching blade 222 is positioned in the contact range, whereby the process is advanced to step ST17. The process is advanced from step ST13 to step ST17, in a period between time t231 to time t234 in FIG. 11.

In step ST14, the paper sheet width direction movement control portion 310 controls the slide motor 272 of the paper sheet width direction movement portion 270 so as to move the punching unit 210 (the punching blade 222) to the paper sheet width direction waiting position in the paper sheet width direction D2, since the punching blade 222 is positioned in the non-contact range (the number of pulses based on the reference position detection hole 251*b* in FIG. 10 is two, which is less than or equal to three). Specifically, by driving the slide motor 272 for a predetermined time period, the punching unit 210 is moved to the paper sheet width direction waiting position. The operation of the punching apparatus 200 in step ST14 is executed at time t15 in FIG. 10.

In step ST15, the reference position detection sensor 252 determines whether or not indication of a detected signal has changed from OFF (light is blocked) to ON (light is transmitted). When indication of the signal detected by the reference position detection sensor 252 changes from OFF (light is blocked) to ON (light is transmitted), it is determined that the punching blade 222 is positioned at the punching reference position. Here, it is determined whether or not the punching blade 222 is positioned in a range of the punching reference position due to the eccentric cam member 231 having been rotated in the second rotation direction R2. When indication of the signal detected by the reference position detection sensor 252 changes from OFF (light is blocked) to ON (light is transmitted) (YES), the process is advanced to step ST16. When the signal detected by the reference position detection sensor 252 still indicates OFF (light is blocked) (NO), the process is returned to step ST15.

In step ST16, the cam rotation driving control portion 320 stops the rotation of the eccentric cam member 231 in the second rotation direction R2. In the description herein, since the rotation of the eccentric cam member 231 in the second rotation direction R2 is driven by a pulse-like intermittent minus voltage signal, even when the rotation of the eccentric cam member 231 in the second rotation direction R2 is stopped, the eccentric cam member 231 does not rotate due to inertia and does not move beyond the punching reference position. The operation of the punching apparatus 200 in step ST16 is executed at the end of time t14 in FIG. 10. Thus, the punching blade 222 stops at a position corresponding to the punching reference position, and the process is ended.

When the number of pulses detected by the rotation amount detection sensor 253 is greater than or equal to four (NO) in step ST13, since the punching blade 222 is positioned in the contact range (the number of pulses based on the reference position detection hole 251*b* in FIG. 11 is five, which is greater than or equal to four), the cam rotation driving control portion 320 controls the punching rotation motor 242 so as to maintain rotation of the eccentric cam member 231 in the second rotation direction R2 such that the punching blade 222 is moved toward the punching reference position, in step ST17. Thus, the punching blade 222 is returned toward the punching reference position. In the present embodiment, since the number of pulses based on the reference position detection hole 251*b* is five, the punching rotation motor 242 is controlled so as to continuously rotate the eccentric cam member 231 in the second rotation direction R2 by an amount, corresponding to two pulses, toward the reference position detection hole 251*b* (see FIG. 11).

Subsequently, the punching blade position determination portion 330 determines whether or not the punching blade 222 has been returned to the non-contact position. Specifically, as in step ST13, the punching blade position determination portion 330 determines whether or not a moving distance of the punching blade 222 from the punching reference position is in the predetermined range, with reference to the information stored in the post-processing storage portion 400, based on the reference position information, for the punching blade 222, detected by the reference position detection sensor 252, and an amount of rotational movement, of the eccentric cam member 231, detected by the rotation amount detection sensor 253. When the punching blade 222 is positioned in the non-contact range (YES), the process is advanced to step ST14 in order to move the punching unit 210 in the paper sheet width direction D2. When the punching blade 222 is positioned in the contact range (NO), the process is returned to step ST17 in order to wait for completion of movement of the punching blade 222 into the non-contact range. The operation of the punching apparatus 200 in step ST17 is executed at time t235 and time t236 in FIG. 11.

The operations performed in and after step ST14 when the punching blade 222 is positioned in the non-contact range (YES) in step ST17, are the same as the operations in and after step ST14 as described above. In the operations performed in and after step ST14 when the punching blade 222 is positioned in the non-contact range (YES) in step ST17, the slide motor 272 is driven at time t25 in FIG. 11. The rotation of the eccentric cam member 231 in the second rotation direction R2 is stopped at the end of time t24 in FIG. 11.

In the post-processing apparatus 100 of the copy machine 1, as described above, according to the present embodiment, the following effects can be obtained. In the post-processing apparatus 100 of the present embodiment, even if the punching blade 222 has moved beyond the punching reference position toward the through hole punching position, the punching rotation motor 242 is driven so as to rotate the eccentric cam member 231 in the second rotation direction R2 opposite to the first rotation direction R1 such that the punching blade 222 is moved to the punching reference position, and the punching blade 222 can be moved to the paper sheet width direction waiting position. Thus, the punching blade 222 can be moved in the paper sheet width direction D2 with the punching blade 222 being distant from the paper sheet T. Therefore, the paper sheet T is less likely to be damaged.

Further, in the present embodiment, in a case where the punching blade 222 is assuredly positioned in the non-contact range, the punching blade 222 can be moved in the paper sheet width direction D2. Therefore, damage on the paper sheet T can be further reduced. Further, when it is determined that the punching blade 222 is positioned in the non-contact range, the punching blade 222 is moved in the paper sheet width direction D2. Therefore, the punching blade 222 can be efficiently moved to and positioned at the paper sheet width direction waiting position. Thus, the punching process for the paper sheet T to be subsequently subjected to the punching process can be quickly prepared. Therefore, the punching process by the punching blade 222 can be efficiently executed.

Further, in the present embodiment, in a case where the punching blade 222 is controlled so as to return to the punching reference position after the punching blade 222 has moved beyond the punching reference position, even if the punching blade 222 is positioned in the contact range, the punching blade 222 is moved into the non-contact range, and the punching blade 222 can be thereafter moved to the paper sheet width direction waiting position. Thus, the punching blade 222 can be moved in the paper sheet width direction D2 with the punching blade 222 being assuredly distant from the paper sheet T.

Further, in the present embodiment, each time the paper sheet T is conveyed, the punching blade 222 is moved to the punching reference position based on a position of the end, in the paper sheet width direction D2, of the paper sheet T. Thus, even when the paper sheet T is conveyed by the second paper sheet conveying portion 110 with the position of the paper sheet T being deviated in the paper sheet width direction D2, punched holes can be formed at predetermined positions, in the paper sheet width direction D2, of the paper sheet T.

Although the preferred embodiment of the post-processing apparatus 100 of the copy machine 1 according to the present disclosure has been described above, the post-processing apparatus 100 of the copy machine 1 according to the present disclosure is not limited to the embodiment described above, and can be implemented in various manners.

For example, although, in the embodiment described above, the punching blade 222 is moved in the paper sheet width direction D2 orthogonal to the conveying direction D1 of the paper sheet T, the present disclosure is not limited thereto. For example, the punching blade 222 may be moved in a direction that is tilted, by a predetermined angle, relative to the conveying direction D1 of the paper sheet T.

Further, for example, although, in the embodiment described above, the punching blade 222 is moved from the punching reference position to the through hole punching position by moving the punching blade 222 in the up-down direction due to rotation of the eccentric cam member 231, the present disclosure is not limited thereto. For example, as a structure in which the punching blade 222 is moved from the punching reference position to the through hole punching position, a structure in which a punching apparatus uses a cylindrical rotation member that rotates about a rotation shaft, and a punching blade disposed so as to project from the circumferential surface of the rotation member, may be used. In this case, the punching blade of the punching apparatus reciprocates between the punching reference position and the through hole punching position by rotating the rotation member in a constant direction, to form punched holes in the paper sheet T.

The type of the image forming apparatus of the present disclosure is not limited to any specific type. Examples of the image forming apparatus may include printers, facsimile machines, and multifunctional peripherals incorporating the entirety or some of functions of these machines, as well as copy machines. The sheet-like medium on which image formation is performed is not limited to a paper sheet, and may be, for example, a film sheet.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A post-processing apparatus connectable to an image forming apparatus body that forms an image on a medium on which image formation is performed, the post-processing apparatus comprising:

a conveying portion that conveys a medium on which image formation is performed; and a punching apparatus that performs a punching process on the medium on which image formation is performed, the medium being conveyed by the conveying portion, wherein the punching apparatus includes:

a punching blade that is movable between a punching reference position and an orthogonal direction waiting position, and is movable between the punching reference position and a through hole punching position at which the medium on which image formation is performed is penetrated, the punching reference position being a position which is vertically distant from a surface of the medium on which image formation is performed and at which the punching process is performed for the medium on which image formation is performed, the orthogonal direction waiting position being a position that is distant, by a predetermined distance, from the punching reference position in an orthogonal direction that is orthogonal to a direction in which the medium on which image formation is performed is conveyed;

an orthogonal direction movement portion that moves the punching blade in the orthogonal direction;

a converting mechanism that has a rotation member that can rotate in a first rotation direction, and converts rotational movement of the rotation member in the first rotation direction to reciprocating movement of the punching blade between the punching reference position and the through hole punching position;

a rotation driving portion that drives rotation of the rotation member;

a reference position detection portion that can determine that the punching blade is positioned at the punching reference position or that the punching blade is not positioned at the punching reference position;

an orthogonal direction movement control portion that controls the orthogonal direction movement portion so as to move the punching blade in the orthogonal direction;

a rotation driving control portion that controls the rotation driving portion so as to stop rotating the rotation member such that the punching blade is moved from the through hole punching position to the punching reference position and is stopped at the punching reference position;

a rotation amount detection portion that detects an amount of rotational movement of the rotation member; and a punching blade position determination portion that determines whether or not a moving distance of the punching blade from the punching reference position is in a predetermined range, based on reference position information, for the punching blade, detected by the reference position detection portion, and the amount of rotational movement of the rotation member detected by the rotation amount detecting portion, the rotation driving control portion controls the rotation driving portion so as to rotate the rotation member in a second rotation direction opposite to the first rotation direction at a rotation speed slower than a rotation speed of the rotation in the first rotation direction such that the punching blade is moved toward the punching reference position, when the reference position detection portion determines that the punching blade has moved beyond the punching reference position toward the through hole punching position, in a case where the rotation driving portion is controlled so as to stop rotating the rotation member such that the punching blade is stopped at the punching reference position, the orthogonal direction movement control portion starts, before the punching blade is returned to the punching reference position, a movement control of controlling the orthogonal direction movement portion so as to move the punching blade toward the orthogonal direction waiting position, when the punching blade position determination portion determines that the moving distance of the punching blade from the punching reference position is in the predetermined range while the rotation driving control portion controls the rotation driving portion so as to rotate the rotation member in the second rotation direction such that the punching blade is moved toward the punching reference position, the rotation driving control portion controls the rotation driving portion so as to maintain rotation of the rotation member in the second rotation direction such that the punching blade is moved toward the punching reference position, when the punching blade position determination portion determines that the moving distance of the punching blade from the punching reference position is not in the predetermined range, and the orthogonal direction movement control portion starts, before the punching blade is returned to the punching reference position, the movement control of controlling the orthogonal direction movement portion so as to move the punching blade toward the orthogonal direction waiting position, when the punching blade position determination portion determines that the moving distance of the punching blade from the punching reference position is in the predetermined range while the rotation driving control portion controls the rotation driving portion so as to maintain rotation of the rotation member in the second rotation direction.

2. The post-processing apparatus according to claim 1, wherein the predetermined range, determined by the punching blade position determination portion, for a moving distance of the punching blade from the punching reference position is a range in which the punching blade does not contact with the medium on which image formation is performed.

3. The post-processing apparatus according to claim 1, wherein the rotation member is a cam member.

4. The post-processing apparatus according to claim 1, wherein the punching apparatus further includes an orthogonal direction end position detection portion that detects a position of an end, in the orthogonal direction, of the medium on which image formation is performed, and the orthogonal direction movement control portion controls the orthogonal direction movement portion so as to position the punching blade at the punching reference position, based on position information for the end, in the orthogonal direction, of the medium on which image formation is performed, the end being detected by the orthogonal direction end position detection portion.

5. An image forming apparatus, comprising:

an image forming apparatus body that forms an image on a medium on which image formation is performed; and a post-processing apparatus connectable to the image forming apparatus main body, wherein the post-processing apparatus includes:

a conveying portion that conveys a medium on which image formation is performed; and a punching apparatus that performs a punching process on the medium on which image formation is performed, the medium being conveyed by the conveying portion, the punching apparatus includes:

a punching blade that is movable between a punching reference position and an orthogonal direction waiting position, and is movable between the punching reference position and a through hole punching position at which the medium on which image formation is performed is penetrated, the punching reference position being a position which is vertically distant from a surface of the medium on which image formation is performed and at which the punching process is performed for the medium on which image formation is performed, the orthogonal direction waiting position being a position that is distant, by a predetermined distance, from the punching reference position in an orthogonal direction that is orthogonal to a direction in which the medium on which image formation is performed is conveyed;

an orthogonal direction movement portion that moves the punching blade in the orthogonal direction;

a converting mechanism that has a rotation member that can rotate in a first rotation direction, and converts rotational movement of the rotation member in the first rotation direction to reciprocating movement of the punching blade between the punching reference position and the through hole punching position;

a rotation driving portion that drives rotation of the rotation member;

a reference position detection portion that can determine that the punching blade is positioned at the punching reference position or that the punching blade is not positioned at the punching reference position;

an orthogonal direction movement control portion that controls the orthogonal direction movement portion so as to move the punching blade in the orthogonal direction;

a rotation driving control portion that controls the rotation driving portion so as to stop rotating the rotation member such that the punching blade is moved from the through hole punching position to the punching reference position and is stopped at the punching reference position;

a rotation amount detection portion that detects an amount of rotational movement of the rotation member; and a punching blade position determination portion that determines whether or not a moving distance of the punching blade from the punching reference position is in a predetermined range, based on reference position information, for the punching blade, detected by the reference position detection portion, and the amount of rotational movement, of the rotation member, detected by the rotation amount detecting portion, the rotation driving control portion controls the rotation driving portion so as to rotate the rotation member in a second rotation direction opposite to the first rotation direction at a rotation speed slower than a rotation speed of the rotation in the first rotation direction such that the punching blade is moved toward the punching reference position, when the reference position detection portion determines that the punching blade has moved beyond the punching reference position toward the through hole punching position, in a case where the rotation driving portion is controlled so as to stop rotating the rotation member such that the punching blade is stopped at the punching reference position, the orthogonal direction movement control portion starts, before the punching blade is returned to the punching reference position, a movement control of controlling the orthogonal direction movement portion so as to move the punching blade toward the orthogonal direction waiting position, when the punching blade position determination portion determines that the moving distance of the punching blade from the punching reference position is in the predetermined range while the rotation driving control portion controls the rotation driving portion so as to rotate the rotation member in the second rotation direction such that the punching blade is moved toward the punching reference position, the rotation driving control portion controls the rotation driving portion so as to maintain rotation of the rotation member in the second rotation direction such that the punching blade is moved toward the punching reference position, when the punching blade position determination portion determines that the moving distance of the punching blade from the punching reference position is not in the predetermined range, and the orthogonal direction movement control portion starts, before the punching blade is returned to the punching reference position, the movement control of controlling the orthogonal direction movement portion so as to move the punching blade toward the orthogonal direction waiting position, when the punching blade position determination portion determines that the moving distance of the punching blade from the punching reference position is in the predetermined range while the rotation driving control portion controls the rotation driving portion so as to maintain rotation of the rotation member in the second rotation direction.

6. A punching apparatus that performs a punching process on a sheet conveyed by a conveying portion which conveys sheets, the punching apparatus comprising:

a punching blade that is movable between a punching reference position and an orthogonal direction waiting position, and is movable between the punching reference position and a through hole punching position at which the sheet is penetrated, the punching reference position being a position which is vertically distant from a surface of the sheet, and at which the punching process is performed for the sheet, the orthogonal direction waiting position being a position that is distant, by a predetermined distance, from the punching reference position in an orthogonal direction that is orthogonal to a direction in which the sheet is conveyed;

an orthogonal direction movement portion that moves the punching blade in the orthogonal direction;

a converting mechanism that has a rotation member that can rotate in a first rotation direction, and converts rotational movement of the rotation member in the first rotation direction to reciprocating movement of the punching blade between the punching reference position and the through hole punching position;

a rotation driving portion that drives rotation of the rotation member;

a reference position detection portion that can determine that the punching blade is positioned at the punching reference position or that the punching blade is not positioned at the punching reference position;

an orthogonal direction movement control portion that controls the orthogonal direction movement portion so as to move the punching blade in the orthogonal direction;

a rotation driving control portion that controls the rotation driving portion so as to stop rotating the rotation member such that the punching blade is moved from the through hole punching position to the punching reference position and is stopped at the punching reference position;

a rotation amount detection portion that detects an amount of rotational movement of the rotation member; and a punching blade position determination portion that determines whether or not a moving distance of the punching blade from the punching reference position is in a predetermined range, based on reference position information, for the punching blade, detected by the reference position detection portion, and the amount of rotational movement, of the rotation member, detected by the rotation amount detecting portion, wherein the rotation driving control portion controls the rotation driving portion so as to rotate the rotation member in a second rotation direction opposite to the first rotation direction at a rotation speed slower than a rotation speed of the rotation in the first rotation direction such that the punching blade is moved toward the punching reference position, when the reference position detection portion determines that the punching blade has moved beyond the punching reference position toward the through hole punching position, in a case where the rotation driving portion is controlled so as to stop rotating the rotation member such that the punching blade is stopped at the punching reference position, the orthogonal direction movement control portion starts, before the punching blade is returned to the punching reference position, a movement control of controlling the orthogonal direction movement portion so as to move the punching blade toward the orthogonal direction waiting position, when the punching blade position determination portion determines that the moving distance of the punching blade from the punching reference position is in the predetermined range while the rotation driving control portion controls the rotation driving portion so as to rotate the rotation member in the second rotation direction such that the punching blade is moved toward the punching reference position, the rotation driving control portion controls the rotation driving portion so as to maintain rotation of the rotation member in the second rotation direction such that the punching blade is moved toward the punching reference position, when the punching blade position determination portion determines that the moving distance of the punching blade from the punching reference position is not in the predetermined range, and the orthogonal direction movement control portion starts, before the punching blade is returned to the punching reference position, the movement control of controlling the orthogonal direction movement portion so as to move the punching blade toward the orthogonal direction waiting position, when the punching blade position determination portion determines that the moving distance of the punching blade from the punching reference position is in the predetermined range while the rotation driving control portion controls the rotation driving portion so as to maintain rotation of the rotation member in the second rotation direction.

* * * * *

UNITED STATES PATENT AND TRADEMARK OFFICE

CERTIFICATE OF CORRECTION

PATENT NO. : 9,061,433 B2
APPLICATION NO. : 14/043728
DATED : June 23, 2015
INVENTOR(S) : Shigeaki Nakamura It is certified that error appears in the above-identified patent and that said Letters Patent is hereby corrected as shown below:

In the claims

Claim 5, column 25, line 64, delete “main”.

Signed and Sealed this
Twelfth Day of January, 2016

Michelle K. Lee

Michelle K. Lee
*Director of the United States Patent and Trademark Office*